US006069306A

United States Patent [19]

Isvan et al.

[11] Patent Number: 6,069,306

[45] Date of Patent: May 30, 2000

[54] STRINGED MUSICAL INSTRUMENT AND METHODS OF MANUFACTURING SAME

[75] Inventors: Osman K. Isvan, Nashville, Tenn.; John S. Allen, Waltham, Mass.

[73] Assignee: Gibson Guitar Corp., Nashville, Tenn.

[21] Appl. No.: 09/258,953

[22] Filed: Mar. 1, 1999

[51] Int. Cl.[7] ..... G10D 1/08

[52] U.S. Cl. ..... 84/267; 84/293; 84/314 R

[58] Field of Search ..... 84/267, 293, 314 R

[56] References Cited

U.S. PATENT DOCUMENTS

| | | | |
|---|---|---|---|
| D. 265,835 | 8/1982 | Rickard | D17/21 |
| 651,304 | 6/1900 | Eriksen . | |
| 2,489,657 | 11/1949 | McBride | 84/317 |
| 2,649,828 | 8/1953 | Maccaferri | 84/314 |
| 2,714,326 | 8/1955 | McCarty | 84/299 |
| 2,813,448 | 11/1957 | Robinson | 84/297 |
| 3,237,502 | 3/1966 | Moseley | 84/267 |
| 3,599,524 | 8/1971 | Jones | 84/312 |
| 3,688,632 | 9/1972 | Perez | 84/314 R |
| 3,894,468 | 7/1975 | Dunlap | 84/314 |
| 4,023,460 | 5/1977 | Kuhnke | 84/314 |
| 4,069,733 | 1/1978 | Quan | 84/299 |
| 4,132,143 | 1/1979 | Stone | 84/314 |
| 4,137,813 | 2/1979 | Stone et al. | 84/314 |
| 4,208,941 | 6/1980 | Wechter | 84/298 |
| 4,236,433 | 12/1980 | Holland | 84/1.16 |
| 4,295,404 | 10/1981 | Smith | 84/314 |
| 4,425,832 | 1/1984 | Peavey | 84/298 |
| 4,620,470 | 11/1986 | Vogt | 84/314 |
| 4,697,492 | 10/1987 | Freed | 84/1.16 |
| 4,852,450 | 8/1989 | Novak | 84/314 |
| 4,878,413 | 11/1989 | Steinberger | 84/314 |
| 4,911,055 | 3/1990 | Cipriani | 84/299 |
| 4,951,543 | 8/1990 | Cipriani | 84/298 |
| 4,981,064 | 1/1991 | Vogt | 84/314 |
| 5,052,260 | 10/1991 | Cipriani | 84/298 |

(List continued on next page.)

OTHER PUBLICATIONS

Oct. 1996 Guitar Player magazine pp. 121, 122 and 150, article entitle "The Buzz Feiten Tuning System".

Jun. 1998 Electronic Musician magazine excerpt entitled "The Buzz on Tuning".

Jul. 1998 Guitar Shop magazine p. 90 article entitled "The Leaning Frets of Pisa!".

Acoustic Guitar magazine May/Jun. 1994 article entitled "Fine–Tuning New approaches to the old problems of equal temperament".

*Primary Examiner*—David S. Martin
*Assistant Examiner*—Shih-yung Hsieh
*Attorney, Agent, or Firm*—Lucian Wayne Beavers Waddey & Patterson

[57] ABSTRACT

The present invention relates to musical instruments and methods and apparatus for producing notes of a musical scale with real strings. More particularly, it relates to the division by frets, of the fingerboard, or neck, of a fretted stringed musical instrument, to obtain a desired musical scale with a specific set of strings. One embodiment of the invention is described in which the 12-tone equal-tempered scale is accurately produced on a guitar with steel strings having sufficient bending stiffness to cause audible intonation errors inherent in steel-stringed guitars of prior art. According to another embodiment of the invention, the musical scale is additionally tempered to approximate the 12-tone, equal-tempered scale while minimizing audible beats that occur when playing intervals and chords due to inharmonic frequency components inherent in tones generated by vibrating guitar strings. Manufacturing methods with respect to wound strings, and with respect to boundary conditions, are also explained. The calculation of fret distances from the bridge are done individually for each combination of fret and string. These calculations include a compensation for the tension increase resulting from fretting the string. As a result, the choice of action profile and the choice of string properties are decoupled from tuning and intonation, and a guitar can be built to play in tune with a given action profile with an independently given set of strings.

69 Claims, 8 Drawing Sheets

U.S. PATENT DOCUMENTS

| | | | |
|---|---|---|---|
| 5,063,818 | 11/1991 | Salazar | 84/314 |
| 5,133,239 | 7/1992 | Thomas | 84/314 R |
| 5,208,410 | 5/1993 | Foley | 84/307 |
| 5,404,783 | 4/1995 | Feiten et al. | 84/298 |
| 5,481,956 | 1/1996 | LoJacono et al. | 84/314 |
| 5,600,079 | 2/1997 | Feiten et al. | 84/312 |
| 5,696,337 | 12/1997 | Hall | 84/314 |
| 5,728,956 | 3/1998 | Feiten et al. | 84/314 |
| 5,814,745 | 9/1998 | Feiten et al. | 84/312 |

STRINGED MUSICAL INSTRUMENT AND METHODS OF MANUFACTURING SAME

BACKGROUND OF THE INVENTION

Just And Mean-Tone Tunings

The octave is universally recognized as the most natural musical interval other than the unison. Traditionally, the division of the octave into smaller intervals was made with frequency ratios of small integers (called "just" intervals) so that harmonic relationships between the notes could be achieved. It was recognized that a scale composed entirely of just intervals had inevitable pitch errors because concatenated just intervals do not form an exact octave. With fixed-pitch instruments, various tunings evolved, in which the residual errors, known as commas, were lumped onto different intervals of the musical scale. Mean-tone tuning was invented to distribute the comma onto two adjacent intervals, such that neither interval had a large amount of error compared to their "just" counterparts.

Tempered Tunings

The frequency chosen to begin and end the scale defines the key of a musical expression. The key, in turn, defines the frequencies of the set of notes within the scale. Over the most recent several centuries, transitions between multiple keys within the same piece of music became a prominent feature of music. The necessity to play notes from all keys on demand presented special challenges in tuning the instruments, because, on most common instruments with fixed tuning, such as 12-tone keyboards, near-harmonious tunings, such as the traditional mean tone tuning, could not be achieved in multiple keys simultaneously. This lead to various compromised tunings and the concept of "tempering" the division of the octave to facilitate transposing between keys without re-tuning. Mean-tone tuning, which can be considered a tempered scale itself, found its ultimate expression in equal temperament, in which the octave is divided into intervals that are exactly equal to one another. With the equal-tempered scale, the comma is spread onto all intervals of the octave.

It should be noted that the equal-tempered scale compromises the harmony found in "just" and mean-tone tunings in favor of the freedom to change keys. But because music in Western cultures has continued to evolve within this scale, and influenced other cultures as well, key transpositions have become a necessary part of a significant musical heritage. As a result, a contemporary musical instrument must be able to produce, as accurately as possible, the 12-tone equal-tempered scale.

Equal Temperament and Geometric Series

A series of numbers in which each number is a constant multiple of the previous number is called a geometric series and the constant is called the geometric constant. The frequencies of the descending 12-tone equal-tempered scale are comprised of a geometric series with a geometric constant k whose value is $$k = \frac{1}{2^{1/12}}$$

Here, the number 2 represents the octave ratio, and 12 is the number of intervals within the octave. If truncated after 4 significant digits, this constant yields the decimal value k=0.9438.

The Rule Of 18

A common practice in the manufacture of the neck of a guitar is known as "the rule of 18". This rule requires that starting with the first fret from the nut, each fret be placed at 17/18 of the previous fret's distance to the bridge. As a consequence, the vibrating lengths of a string being fretted at successive frets comprise a geometric series with a geometric constant of 17/18. The decimal equivalent of the fraction 17/18, accurate to 4 significant digits, is 0.9444. This value is close to the value k within approximately 0.06%. In other words, the rule of 18 divides the neck of a musical instrument with nearly the same relationship as the frequencies of the 12-tone equal tempered scale.

U.S. Pat. No. 2,649,828 by Maccaferri, U.S. Pat. No. 4,132,143 by Stone, and U.S. Pat. No. 5,600,079 by Feiten make references to the inaccuracy of the fraction 17/18. Maccaferri and Feiten give accurate decimal values for k.

Whether the fraction 17/18 or a more accurate value of k is used, when building a guitar neck prior to the present invention, the frets had to be located with respect to scale length, but without respect to any other dimensions of the guitar or physical properties of strings.

With modern manufacturing it is not necessary to cut fret grooves one at a time or to calculate one fret's location from measurements on another. On a guitar neck that is divided conventionally, with the geometric constant k, the distance of any fret from the bridge can be represented for all frets by the single mathematical expression $$L_n = \frac{L_0}{2^{n/12}} \tag{1}$$

In equation (1) n is the fret number, and $L_n$ is the active length of the string (distance from active fret to bridge). $L_0$ (distance between nut and bridge) is defined as the scale length of the instrument. Equation (1) defines the location of all frets on an instrument correctly built according to the prior-art technique of geometric neck division. Referring to the geometric constant of equal temperament, note that Equation (1) can also be written as $$L_n = L_0 \cdot k^n$$

This equation that defines fret locations of a conventional guitar contrasts with the equation that defines fret locations according to the present invention, in that the latter equation contains additional terms. These additional terms relate to string properties.

SUMMARY OF THE INVENTION

The present invention relates to musical instruments. In particular, the present invention relates to instruments and methods for producing accurately tuned notes on fretted instruments, and other related methods and devices.

One embodiment of the invention is a stringed musical instrument comprising a bridge, a neck, a nut, and a plurality of frets. The frets are spaced along the neck at respective distances from the nut. At least one of the respective distances from the nut is calculated from a predetermined formula having a string stiffness parameter or parameters.

In another embodiment of a stringed musical instrument, each fret includes a first portion and a second portion. The first portion of at least one of the frets is spaced a respective first portion distance from the nut. The respective first portion distance of the one fret is calculated from a predetermined formula having a first string stiffness parameter. The formula for calculating the location of the second portion of the fret relative to the nut includes a second string stiffness parameter, rather than the first string stiffness parameter.

As will be apparent from the teachings herein, the present invention also includes methods of manufacturing musical instruments. One method comprises the steps of calculating the desired positions at which to locate the frets, and locating the frets at the desired positions. The step of calculating is a function of the respective stiffnesses of the respective strings. Generally, the stiffnesses may include bending components, longitudinal components, or a combination of the two.

Another method of manufacturing a musical instrument comprises the steps of selecting a musical scale, and calculating an open-scale length for a first real string. The first real string has a stiffness to produce a first open-scale note of the musical scale. And, the step of calculating includes solving a formula having a string stiffness parameter and utilizing the first string stiffness as value for the stiffness parameters.

One embodiment of the invention comprises the steps of utilizing real strings having real stiffnesses; calculating the desired positions at which to locate the frets; and locating the frets at the desired positions. The step of calculating the positions includes utilizing a formula accounting for the real stiffnesses of the real strings. Tension changes due to fretting are accounted for in some embodiments.

The invention also includes a stringed musical instrument comprised in part of a neck, a plurality of frets, and a nut. The neck has a longitudinal axis. The frets are oblique relative to the longitudinal axis of the neck. In this embodiment, the nut also is perpendicular to the longitudinal axis of the neck.

One stringed musical instrument according to the invention includes frets fanned across the neck. A majority of the fanned frets are oblique relative to the longitudinal axis of the neck. In some embodiments, at least two of the fanned frets are parallel to each other.

The present invention also comprises a fingerboard for a musical instrument. One embodiment comprises the frets' each having a first portion located at a predetermined distance relative to a nut of the musical instrument. Generally, the predetermined distances are calculated for a first real string having a stiffness such that the first real string will produce notes of a predetermined scale. The formula for locating the first portions of the frets for the first real string may include a tension increase due to fretting A method of producing notes of a musical scale is encompassed by the present invention. One method comprises the steps of selecting a musical scale; stringing a musical instrument with a real string and locating a plurality of frets under the real string The frets are located such that when the real string is depressed at one of the frets and plucked the real string will produce a note of the aforementioned selected musical scale. The step of locating the frets includes calculating respective distances relative to the nut with a formula having one or more stiffness parameters and mass parameters of the real string. A tension increase parameter equal to the tension increase of a real string as it is depressed to make contact with the fret is included in the formula for some embodiments.

Another method of producing notes of a musical scale comprises the steps of calculating a plurality of locations to depress a real string having a stiffness. Typically the real string has a corresponding tension increase. The method also includes depressing the real string at one of the fret locations and vibrating the real string. The step of calculating the fret location includes accounting for the stiffness of the real string. The method may account for tension increase of the real string as well.

The invention also includes a method of achieving accurate tuning of a stringed instrument. One method comprises the steps of selecting a predetermined musical scale and positioning the frets under each real string to account for a respective stiffness of each string.

Accordingly, an object of the present invention is to manufacture a guitar or similar instrument, the fret locations of which are chosen to accurately produce the frequencies of a desired scale, taking into account the frequency shifts produced by the stiffness of the strings and by tension increase due to string depression while fretting.

Another object of the present invention is to manufacture a fretted musical instrument, the fret locations on which are chosen to minimize beats between the partials of the notes played simultaneously, for example when playing a chord.

Another object is to provide fretted musical instruments having a longitudinal neck profile selected to control the tension increase upon fretting of the strings.

Other objects and advantages of the present invention will be apparent to those of skill in the art from the teachings disclosed herein, including reference to the attached drawings and claims.

DESCRIPTION OF THE PREFERRED EMBODIMENTS

Figure 1:
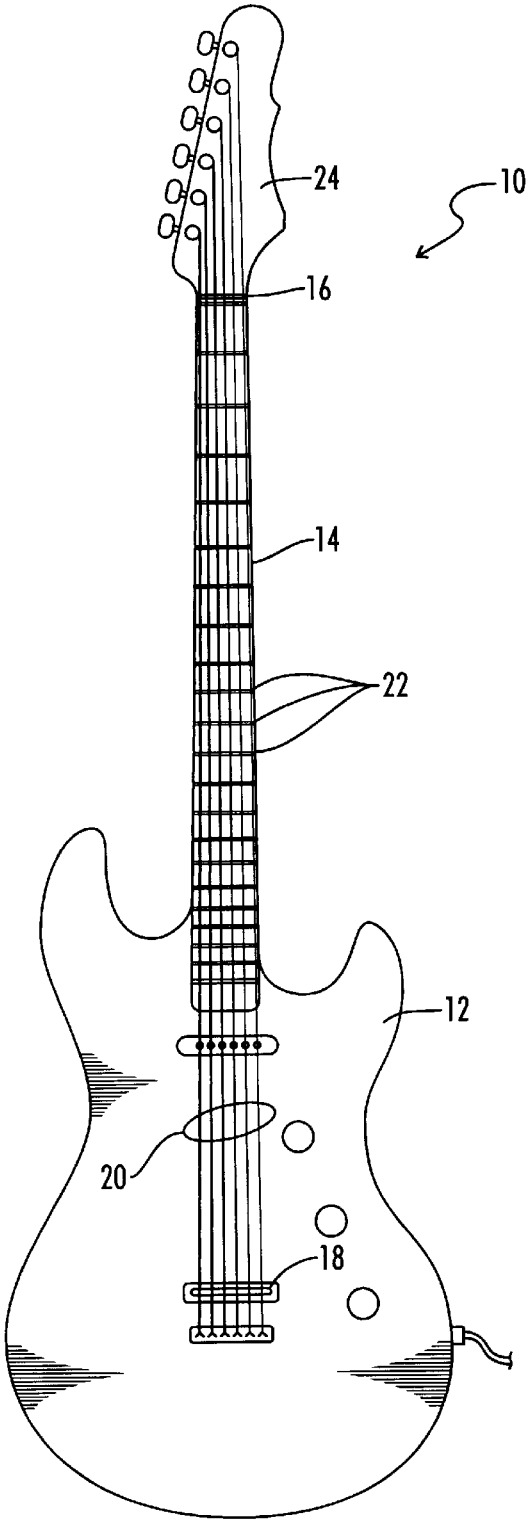
FIG. 1 (PRIOR ART)
FIG. 1 is a plan view of a prior art stringed instrument.

The present invention relates to stringed musical instruments. More particularly the present invention relates to methods of manufacturing fretted stringed musical instruments in such a way that notes of musical scales can be produced accurately. These methods, and apparatus related thereto, are accomplished by accounting for the stiffness in, and in some embodiments tension increase due to fretting of, real strings of the stringed musical instrument. The present invention will be most readily understood by reference to the attached drawings wherein like reference numerals and characters refer to like parts.

In reality, a guitar string, for example, is not an ideal string as defined in the Background Section. It has bending stiffness due to its thickness and modulus of elasticity. The present invention utilizes calculations with additional terms, as compared to ideal string calculations, which pertain to certain physical properties of strings, and to dimensions other than the scale length of the instrument.

Distinction Between Free Vibrations Of Ideal Strings And Real Strings

For clarity and convenience, we shall define and explicitly classify three distinct categories of string-like mechanical structures undergoing transverse vibrations. These are:

a) Cable b) Beam c) Real string.

These structures are hereby defined as follows:

Cable: String-like structure under significant tension that has negligible bending stiffness.

Beam: String-like structure with significant bending stiffness that is under negligible tension.

Real string: String-like structure with significant bending stiffness that is under significant tension.

Referring to these definitions, we point out that the conventional neck division method is commensurate with equal temperament when the strings are assumed to be cables. The present invention includes as one of its objectives, a novel neck division that is commensurate with equal temperament when the strings are assumed to be real strings.

Vibrations Of Cables And Beams

If $L_n$ is the free length of a cable or beam that is stretched between two rigid boundaries, then the fundamental natural frequency, $f$, of its transverse vibrations can be calculated with one of two formulas (Equations 2a and 2b):

A. Cable frequency:

$$f = f_c = \frac{1}{2L_n} \cdot \sqrt{\frac{T}{d}} \tag{2a}$$

where d=linear density (mass per unit length) of string

T=tension.

B. Beam frequency:

$$f = f_b = \frac{X^2}{2 \cdot \pi \cdot L_n^2} \cdot \sqrt{\frac{E \cdot I}{d}} \tag{2b}$$

where

E=Young's modulus.

I=second moment of inertia of cross section.

For a solid circular cross section with a diameter D, $$I = \frac{\pi \cdot D^4}{64}$$

The product of E and I is sometimes referred to as section modulus.

X is a boundary coefficient, whose value depends on boundary conditions. For pinned conditions $X^2$=9.869 and for clamped conditions $X^2$=22.37. See FIG. 10.

It should be noted that only the beam frequency is a function of string diameter and only the cable frequency is a function of tension.

When the frequencies from Equation (2a) with n=1, 2, 3, 4 . . . are compared with those of the 12-tone equal-tempered scale, the physical meaning of the geometric neck division (Equation 1) and the rule of 18 can be understood as follows:

The mathematical expression for the set of frequencies comprising the 12-tone equal-tempered scale is $$f_n = f_0 \cdot 2^{n/12} \tag{3}$$

where $f_0$ is the frequency of the beginning of the scale (tonic), n is the number of the note in the scale, and $f_n$ is the frequency of note n. For example, $f_{12}$ is the frequency of the $12^{th}$ note, or the end of the scale (octave).

If we restrict our analysis with the assumption that the string behaves as a cable, we can combine Equation (2a) and Equation (3) to obtain $$f_n = \frac{1}{2L_n} \cdot \sqrt{\frac{T}{d}} = f_0 \cdot 2^{n/12} \tag{4}$$

One end of the string is constrained at the bridge. When the other end of the string is constrained at the nut (n=0), and string tension T is adjusted until the frequency $f_0$ becomes the standard pitch for the open string, the string is tuned. The tuning of the open string also determines the fretted string frequencies according to Equation (4). For example with the first fret (n=1), Equation (4) becomes $$f_1 = \frac{1}{2L_1} \cdot \sqrt{\frac{T}{d}} = f_0 \cdot 2^{1/12}$$

Frequencies of other frets can be likewise calculated by substituting for n, the desired fret number in equation (4). Hence, by incrementing the fret number one at a time (n=2, 3, 4 . . . etc.), equation (4) yields the scale of frequencies that would be produced by an ideal string (or cable). The number n can be greater than 12 and frequencies in the next octave can be obtained.

Note that if we assume that a guitar string behaves strictly as a cable, and if we further assume that tension would remain the same whether the string is fretted or open, then the frequency produced with the $12^{th}$ fret would be $f_{12}=f_0 \cdot 2$ (per Equation 3). Thus, the octave of the open string frequency would be produced with the $12^{th}$ fret without a length compensation at the bridge being necessary.

Because of action height, fretting the string stretches it slightly, increasing its tension. As a result, a plucked guitar string vibrates at a frequency slightly greater than that obtained from Equation (2). As will be explained below, the resulting frequency difference is not constant throughout the neck, but increases at higher frets.

Researchers involved in the prior art of musical instrument making (luthiers) did not recognize the importance of these phenomena and failed to develop a more accurate formula to divide the neck of an instrument to cancel their effects on tuning. Instead, they invented devices and methods to partially compensate for the problems caused by an incorrect division of the neck. These corrections are collectively known in the prior art as "intonating" the instrument. Part of the reason for this practice is that the accurate neck division is dependent upon the properties of strings to be used, as well as other factors not directly related to the fingerboard.

Intonation methods involve altering the scale length $L_0$ for each string individually. These methods include adding a length compensation to the string at the bridge (U.S. Pat. Nos. 2,740,313; 4,281,576; 4,541,320; 4,236,433; 4,373,417; 4,867,031); at the nut (U.S. Pat. Nos. 3,599,524; and 5,461,956); or both.

Adjusting the string length $L_0$ indeed allows bringing the note produced at any given fret in tune with the note of the open string or another fret. But, as can be seen from Equation (4), changing the length of the string will affect frequencies of all frets at once. If the division of the neck is not correct, each string can be correctly intonated only at one fret. Therefore, intonation devices and guitar tuning systems conceived prior to the present invention are not capable of achieving accurate tuning for the whole instrument. Prior art methods improve intonation in one area of the neck at the expense of another area; they do not properly address a root cause of the problem. A fundamental problem with prior art approaches is that the neck division is incorrect.

Various traditional or modern intonation methods have been developed. These methods represent the art of finding a good compromise. They attempt to make most of the intervals and most of the chords as harmonious as possible when dealing with an incorrectly divided neck, e.g. a neck divided according to Equation (1). Most notably, Feiten Systems, Inc., under "Buzz Feiten Tuning System," has developed a methodical approach for minimizing the audible effects of incorrect neck division with guitars that are compromised by prior-art neck division techniques including the one described by B. Feiten in U.S. Pat. No. 5,600,079.

In guitar strings that are tuned to standard pitch, axial tension is sufficiently high so that when the string is momentarily displaced from its quiescent position, the restoring force that results from bending stiffness is very small compared to that produced by tension. As a result, the natural frequency of vibration of a guitar string is close to that of a cable. But the difference, however small, is audible in most notes produced on a guitar when played as chords.

A guitar string is neither a cable, nor a beam. It is under axial tension but has bending stiffness due to its thickness and modulus of elasticity. As a result, a plucked guitar string vibrates at a frequency that is slightly greater than that obtained from Equation (2a). This greater frequency, $f_s$, of the real string, can be calculated from equations (2a) and (2b) with the additional use of equation (5):

$$f_s = \sqrt{f_c^2 + f_b^2} \tag{5}$$

Referring to equations (2a) and (2b) it should be noticed that for sufficiently long strings under sufficient tension, $f_b$ can become negligibly small relative to $f_c$. If that is the case, as it is evident from equation (5) the string's fundamental frequency $f_s$ is approximately equal to the cable frequency $f_c$. This small frequency difference is not constant throughout the neck but it increases at higher frets because $L_n$ becomes shorter. "Higher frets" is generally intended to mean frets closer to the bridge. Since the active length of the string is between the bridge and the fret, strings fretted closer to the bridge have shorter (or smaller) active lengths.

The following example may serve as a demonstration of the physical meaning of Equations (2) and (5). When the guitar is in tune, the operating frequency is $f_s$. It can be observed that when the string tension is reduced (for example for replacing an old string) the resonant frequency of the string goes down. But when there is no tension left, the frequency does not go down all the way to zero. This remaining low frequency of the limp guitar string is the beam frequency $f_b$. For strings with very small diameter (low bending stiffness), the beam frequency is very low, and when in tune, the string frequency is sufficiently close to the cable frequency. But for guitar strings of relatively large diameter this is not the case.

Due to this small frequency contribution resulting from the bending stiffness of real strings, when the division of the fret board is geometric, the musical intervals that are produced do not exactly constitute equal temperament.

Calculation Of Partial Frequencies And Corresponding String Lengths

The cable frequencies are a harmonic series (integer multiples of the fundamental cable frequency). They are obtained by multiplying the fundamental cable frequency (Equation 2a) by the mode number.

The beam frequencies are calculated for each mode, by substituting in Equation 2b the corresponding value of the modal constant X, depending on boundary conditions.

For pinned boundary conditions (rotationally unconstrained) at both ends of the string, the value of the modal constant X for the $m^{th}$ mode of beam vibration is found as the $m^{th}$ root of the equation $$\sin X = 0$$

For clamped boundary conditions (rotationally constrained) at both ends of the string, the value of the modal constant X for the $m^{th}$ mode of beam vibration is found as the $m^{th}$ root of the equation $$1 - \cos X \cdot \cosh X = 0$$

The first 6 modal constants are shown in Table 1 below.

TABLE 1

| mode number m | $X_m$ pinned | $X_m$ clamped |
|---|---|---|
| 1 | $\pi$ | 4.7300 |
| 2 | $2\pi$ | 7.8532 |
| 3 | $3\pi$ | 10.996 |
| 4 | $4\pi$ | 14.137 |
| 5 | $5\pi$ | 17.279 |
| 6 | $6\pi$ | 20.420 |

Table 1 lists the modal constants for the lowest 6 natural modes of transverse vibrations of a beam with pinned and clamped boundary conditions.

Using the modal constant of the m-th mode ($X_m$) from Table 1 we substitute Equations (2a) and (2b) into Equation (5). Thus we obtain $$f_{m,n} = \frac{1}{2 \cdot L_n} \cdot \sqrt{\frac{T}{d} \cdot m^2 + \frac{E}{d} \cdot \frac{X_m^4}{64 \cdot \pi} \cdot \frac{D^4}{L_n^2}} \tag{6}$$

Equation (6) gives the $m^{th}$ natural frequency of a guitar string fretted at the n-th fret, $f_{m,n}$. This is the frequency of the $m^{th}$ partial of the sound that is produced when it is plucked.

Inversely, if the frequency of a natural mode is known, and the corresponding string length is sought, it is possible to determine the unknown length by squaring and re-arranging Equation (6) and expressing it as a quadratic equation in $(f_{m,n})^2$ and $$\frac{1}{L_n^2}.$$

Thus, $$L_n = \frac{1}{\sqrt{x}}$$

where $$x = \frac{-b + \sqrt{b^2 - 4ac}}{2a}$$

with $$a = \frac{X_m^4 \cdot D^4}{256 \cdot \pi} \cdot \frac{E}{d}$$

$$b = \frac{m^2}{4} \cdot \frac{T}{d}$$

$$c = -(f_{m,n})^2$$

The Effect of Action Height on Intonation:

The open string is tuned when its section between the bridge and the nut is a straight line. However, when the string is depressed to make contact with a fret, its length is increased. This results in an increase in string tension and consequently an upward shift in frequency. The overall objective leading to the present invention was to calculate fret locations to cancel all tuning errors. A method to compensate for the tension increase that results from fretting, is therefore embodied in the invention.

Prior to this invention, attempts have been made to achieve better intonation by bringing the nut closer to the bridge than the rule of 18 standard. For example, Mosrite Guitar Company advertised as early as the 1950's the improvement of intonation achieved by this method. The amount by which to relocate the nut depends on the strings to be used and action height. Individual luthiers have built and customized guitars by relocating the nut, with various degrees of success. More recently, in U.S. Pat. No. 5,600,079, Feiten gives specific amounts by which to reduce the distance between the nut and the first fret, depending on the type of electric or acoustic guitar being designed. The resulting increase in the fret-to-bridge distance relative to scale length lowers the frequency of the fretted string relative to the frequency of the open string. This is intended to compensate for the frequency increase that occurs as a result of fretting the string. However, the amount of tension increase that results from fretting is not constant for all frets, and furthermore it is a function of several variables overlooked by these prior-art neck division methods. These variables include spacing between adjacent frets, fret depth, action height and distance from the nut, among others. Therefore, the exact length compensation that would be necessary to achieve full cancellation is different for each fret.

The prior-art methods of nut placement require all frets to have the same compensation relative to the nut. In contrast, according to the present invention, complete cancellation is achieved with all frets, because the vibrating string length is calculated with Equation (6) for each fret separately from tension, including the calculated tension increase that results from fretting. For the purpose of calculating string elongation and tension increase, the assumption of an approximate, geometric division of the neck (per prior art) yields sufficient accuracy. However, greater accuracy can be obtained by iterations, if desired. The assumption of an approximate, geometric division may be used only to calculate the length increase and associated tension increase that results from fretting.

Figure 12:
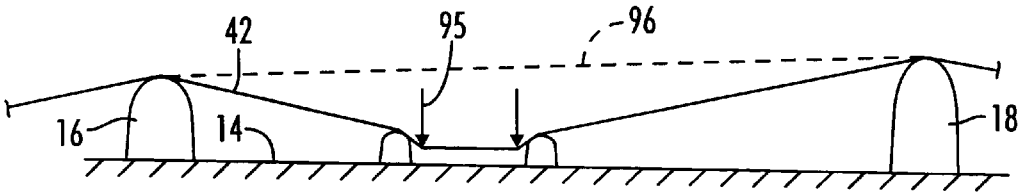
FIG. 12 shows an elevated side schematic view of a fretted string. The open, or non-fretted shape is shown in a phantom line.

In FIG. 12 a string 42 is shown fretted. The open string 96 is shown in a dashed phantom line. The finger force depressing the string is represented by two vectors and shown as arrows 95 that are offset by a finger width. The finger position is shown as approximately 0.5 of the fret spacing and the string 42 is shown to be depressed to approximately 0.5 of the fret depth to the fret board (neck) 14. The finger force is shown perpendicular to the open string (having no component in the direction of string tension). These values and conditions are used for illustrative purposes only and should not be construed as limitations on the invention.

According to the present invention, the length of the straight line connecting the nut to the bridge (dashed line) is subtracted from the sum of the 5 segments representing the fretted string (solid line). This difference is the length increase from fretting, ΔL. Tension increase is calculated from length increase according to Hooke's law with the following formula:

$$\Delta T = \Delta L \cdot \frac{\pi \cdot D^2 \cdot E}{4 \cdot (L_0 + L_1 + L_2)}$$

where

ΔT=Tension increase from fretting

ΔL=Length increase from fretting

D=String diameter (for wound strings the effective core—the diameter of a plain string having equivalent longitudinal stiffness—is used).

$L_0$=Length of open string from nut to bridge $L_1$=Idle length beyond nut $L_2$=Idle length beyond bridge For total cancellation of the tuning errors caused by fretting, in Equation (6) the following values of tension T and length $L_n$ should be used:

$T=(T_0+\Delta T)$ (sum of open string tension and tension increase from fretting)

$L_n$=Playing Length (distance from active fret to bridge).

Therefore, according to the present invention, first the longitudinal profile of the neck is determined including the fret heights. This step is independent of frequency. Next, tension increase and total tension are calculated for each fret and string based on approximate fret distances with geometric neck division, and finally the accurate fret distances are calculated to yield desired frequencies for each fret and string according to equation (6).

Longitudinal Profile of the Neck.

Figure 13:
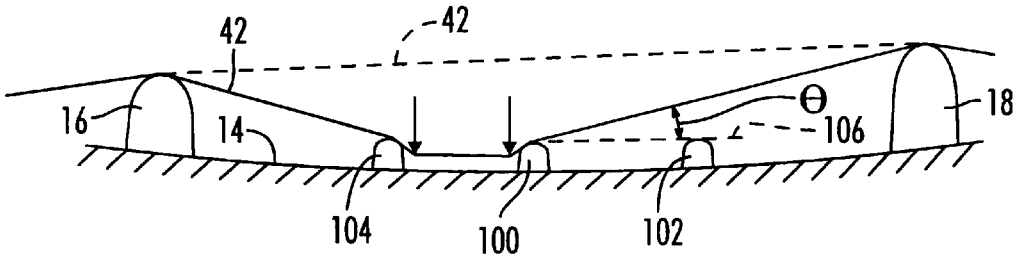
FIG. 13 is a view similar to FIG. 12, schematically showing a curved concave longitudinal neck profile.

The tops of all the frets may be placed in a straight line that is angled relative to the strings, and it is common practice to do so. This straight neck profile has the desirable effect that the tension increase due to fretting remains consistent throughout the neck, causing only minimal intonation errors. However, because the present invention permits total cancellation of frequency errors, and does so at each fret and string combination individually, any neck profile can now be used. A preferred neck profile is described below:

The following description is made with regard to FIG. 13, which is a schematic illustration of the preferred longitudinal neck profile. In FIG. 13, a concave longitudinal neck profile 14 is shown. The string 42 extends over the nut 16 and bridge 18. The unfretted location of string 42 is shown in dashed lines and the fretted position in solid lines. The playing fret or active fret is indicated by the numeral 100. The next higher fret 102 and next lower fret 104 are also shown.

In order to avoid buzzing or rattling when plucked, the string 42 must remain in contact with the fret 100 throughout the excursion range of the string's vibration. The limit for downward (towards the fret board) excursion of the string 42 is established by contact with the next higher fret 102.

The maximum range of excursion before the string buzzes against the next higher fret is $2\theta$, where $\theta$ is the angle whose vertex is the junction of the string with the top of the playing fret and whose legs are the string, and a line 106 from the top of the playing fret 100 to the top of the next higher fret 102. When designing the neck according to the present invention, a preferred longitudinal neck profile can be obtained as follows: First, the longitudinal fret distances from the nut are calculated assuming a geometric neck division (per prior art). Then, for each fret, the slope of the line connecting the top of the playing fret to the top of the next higher fret is chosen such that the angle $\theta$ is constant throughout the neck. When large string amplitudes are desired, a large $\theta$ is chosen. Small values of $\theta$ result in lighter action. The principle of constant $\theta$ angle establishes a curved longitudinal neck profile that is slightly concave as schematically illustrated in FIG. 13. Of course, the value of $\theta$ may be changed in different parts of the range of the neck if desired, resulting in other neck profiles, including, but not limited to, a straight line.

FIG. 13 shows a schematic neck profile. The neck profile is the vertical clearance between the string and fret board (neck), also referred to as the elevation profile. This clearance changes according to a profile (as a function of distance from the nut) along the neck. This profile may have a different shape for each string. If it does, and the strings are in a plane, the fret board will then be a three-dimensional surface. Alternately the strings could be made not to be coplanar and the fret board could then be planar.

Beats Between Partials, Stretched Scales And "Targeted Tuning"

We have explained the design of a guitar neck according to the present invention for a given set of strings and a "target" musical scale such as the 12-tone equal temperament (12-TET). It should be evident to those trained in the art, that the invention is not limited to a specific musical scale, but can be applied to any "target" scale with a mathematically defined set of frequencies. Some examples of such "target" scales are the Pythagorean scale, and the many forms of mean-tone tunings and temperaments. The advantage of these tunings over 12-TET may be realized when playing music that stays in one key or is limited to a few closely related keys. This is a practice that is mostly abandoned. But a scale that is of particular interest is a modified 12-TET whose intervals are stretched according to the inharmonicity of the strings. This concept is called "targeted tuning". In targeted tuning, the fret coordinates are calculated not strictly from the fundamental modes of vibration (Equations 2 and 5, or Equation 6 with m=1), but from equations including fundamental and higher modes of vibration (Equation 6 with $m \leqq 1$).

The sound of a single musical note is comprised of multiple frequency components. Each frequency component is associated with a natural mode of a vibrating structure. The frequencies and relative levels of these components define the tone. On a guitar, the tone of a note being played is defined by natural modes of string vibrations. These modes contain a fundamental frequency and a series of higher frequencies called partials.

The partials of ideal strings (cable frequencies) are integer multiples of the fundamental frequency. Such a tone is referred to as a harmonic tone. With real strings, when tension is sufficiently high, the frequencies of the partials are very close to integer multiples of the fundamental frequency. This near-harmonic relationship among the frequency components of taut strings is the operating principle of all stringed instruments.

When playing intervals and chords with a guitar, string inharmonicity causes a modulation of the tone even when the respective fundamental frequencies are in tune. This modulation is sometimes heard as a cyclic increase and decrease in the amplitudes of some of the partials whose frequencies are close but not identical to the partials from another string being simultaneously played. This phenomenon is known in acoustics as a beat. Beats are strongest when the amplitudes of the beating partials are most nearly equal.

Targeted tuning provides a preferred scale with stretched intervals aimed at minimizing beats when playing chords on fretted instruments. This preferred scale is obtained from string properties which must be either calculated or measured, principles of guitar sound production, the anatomy of the human hand and the psychoacoustics of human hearing as follows:

It is well-known in the art of constructing and tuning pianos and other stringed keyboard instruments that the scale must be "stretched" to sound optimally in tune. On a piano, each note is typically tuned so that its fundamental coincides with the second partial of the note an octave lower, thereby avoiding the most audible and disturbing beats. Since the strings are inharmonic and the second partials are sharp relative to second harmonics of the fundamental, the fundamentals of notes an octave apart therefore stand at ratios slightly greater than 2/1.

A guitar present s far more difficult tuning problems than a piano, because most notes on the guitar can be played on more than one string, and each string has different inharmonicity. Even in combinations of two unisons and a note an octave higher, which are not subject to the compromises of equal temperament, notes can exist on a guitar such that the first note is in tune with the second and the second is in tune with the third, but the third is not in tune with the first. This problem occurs because the ratio between the frequencies of the fundamental and the second partial of the two notes at unison may differ. While unisons are in most cases best tuned to each other by making their fundamentals equal, they are best tuned to the note an octave higher by making their second partials equal to the higher note's fundamental. In this case, the lower notes' fundamentals will no longer be equal.

Furthermore, the most inharmonic string of the quitar is typically its lowest string. Inharmonicity is less on the higher wound strings and then becomes greater with the lowest plain string (usually, the B or G string), decreasing again on the higher plain string or strings. Also, as already described, inharmonicity becomes greater at the higher frets of each string.

Therefore, it becomes necessary to use a more sophisticated scheme than the simple "stretching" of the scale of keyboard instruments to achieve optimal intonation on the guitar.

However, certain mitigating factors may be applied in order to render the problem tractable.

The strongest output of the guitar is typically in its middle frequency range, and the strongest output of any single note is typically in the lowest few partials. Also, it is well known that human hearing is much less sensitive at low frequencies than at midrange frequencies. The rate of beats for equal frequency ratios becomes smaller, the lower the frequency.

The fretting hand can span only a limited range of frets. Therefore, intonation among notes within the span of the hand is more important than intonation among notes which exceed the span of the hand, with one important exception: intonation between notes anywhere on the neck and open strings is also important, since open strings can be played regardless of the location of the hand on the neck.

Each string of the guitar can play only one note at a time. Therefore, precise intonation between notes on a single string is less important than intonation between notes on separate strings.

By applying these characteristics of the guitar and those of human hearing, it becomes possible to reduce and to conceal the intonation errors between strings, as follows:

1) A frequency in the middle of the guitar's range is designated as the "target frequency" for all notes whose fundamental is below that frequency. For purposes of discussion, that frequency will be taken to be the fundamental of the open high E string of the guitar, at approximately 330 Hz.

2) For any note on a lower string whose first, second or fourth partial is nominally at this same frequency, the fret position for that note on that string is determined from Equation 6 to bring the "target" partial exactly into tune with all other partials on other strings which are nominally at this "target" frequency. Since the guitar's strings are inharmonic, and since the inharmonicity is unequal at different frets and on different strings, it should be clear, then, that lower partials of notes with higher partials at the "target" frequency will fall below their ideal pitches, and by varying amounts. However, the intonation error will be largely inaudible because it is in the lowest frequency range of the guitar where beats are slow, the output, whether acoustic or amplified is relatively low, and human hearing is relatively insensitive.

3) At this point, only the frequencies of notes at the "target" frequency and at octave sub-multiples of this frequency have been established. An additional step is required to establish the fundamental frequencies of other notes on each string whose fundamentals are below the "target" frequency. These fundamentals are determined according to a mathematical curve fit whose x values (independent variables) are those of an ideal tuning (usually, 12-tone equal temperament) and whose y values (dependent variables) are established (in step 2) according to the fundamentals of corresponding notes which have a "target" partial.

On some strings, there may not be enough "target" notes within the actual playing range of the string on a guitar to develop a three-point or four-point (typically, quadratic or cubic polynomial) curve fit In these cases, the physical parameters of the string are extrapolated to a greater length to derive the one or two additional points needed.

4) In the range above the "target" frequency, beats are faster and the characteristics of human hearing and of the guitar's output make the beats between the lowest partials the most important ones. Therefore, the fundamental frequencies of most notes in a range above the "target" frequency are established by averaging the frequencies of the second partials of notes an octave lower which are within the span of the fretting hand. These notes are on the second and third strings below the string on which the fundamentals are to be established. Transition into this region from the "targeted" region below it is smooth and automatic, because the second partials on the lower strings and the fundamental on the higher string are identical when they are at the "target" frequency.

5) Due to the rapidly increasing inharmonicity of the low E string in its highest range, tuning the higher frets of other strings to it as in 4) above would result in their being out of tune with the open strings. Also, the higher partials of the highest frets on the low E string are weak, due to the near-central position of the plucking hand on the sounding part of the string, and to the relatively high damping of a short, thick sounding string. And, when higher partials become increasingly inharmonic and weak, difference tones between fundamentals become more important than coincidence between partials in establishing the subjective sense of accurate tuning.

For these reasons, frets in the highest range of the middle strings of the guitar are located to be in tune with coincident partials of other open strings. For example, the $21^{st}$ fret of the G string may be located so its fundamental coincides with the second partial of the open high E string; the $21^{st}$ fret on the D string may be located so its fundamental coincides with the second partial of the open B string; and the $24^{th}$ fret on the A string may be located so its fundamental coincides with the $3^{rd}$ partial of the open D string (in this last case, adjusted for equal temperament so as also to achieve optimum tuning against high frets of the other strings);

6) Smooth transition between the range of tuning by octaves as in 4) and that of tuning to open strings as in 5) is achieved by additional curve-fitting. The resulting intonation in the highest range of the guitar produces the greatest possible harmoniousness, considering that any fret may be played along with open strings.

All in all, then, several techniques are applied to produce the most subjectively accurate and harmonious tuning possible, given the characteristics of the guitar.

In the simple embodiment described above, the compensation for string tension increase and inharmonicity, and the targeted tuning as described up to this point, require that each fret be divided to provide a different length for each string. However, additional techniques are possible to duplicate or closely to approximate the same tuning while using conventional straight frets, which may be either parallel as in the prior art, or angled with respect to each other. These techniques include:

1) Adjustment of the longitudinal profile of the neck (that is, adjustment of the angle $\theta$ at each fret) to achieve values of tension increase at the different frets such as to result in desired values of frequency shift.

2) Use of a spring in series with a string, so as to increase the string's effective longitudinal compliance and therefore to reduce the frequency shift due to tension increase. This measure has the additional advantages of making it possible substantially to equalize the lateral string displacement on all strings to achieve a given frequency shift ("bent note"), and to keep the string tension and therefore the frequency substantially constant despite differing amplitudes of string vibration.

3) Adjustment of the vibrating length of the string at the bridge saddle, as in conventional intonating of the guitar already described.

4) Use of a frequency sensor and/or fret sensor and a computer-controlled servomechanism to adjust the tension of the string to achieve a desired vibration frequency according to which fret is being played.

It can be shown mathematically that measures 1), 2) and 3) taken together, along with an appropriate fret division, can result in a substantially accurate duplication of the desired targeted tuning on all strings. That is, measures 1), 2) and 3) taken together can render the tuning exact on any three frets, with only very minor deviation from the desired tuning at other frets. The analytical approach used is that of geometric curve fitting, similar to the method used in designing achromatic optical lenses. Measure 4 is a "brute force" method which can achieve any desired tuning.

The resulting "targeted tuning" requires a slightly different adjustment of the pitches of the open strings than does the usual division of the neck. This adjustment may be achieved in either of two ways:

1) By adjusting notes which have partials at the "target" frequency so that they do not beat against one another. For this tuning, a "target" frequency at the fundamental of the open high E string is optimal, because this open string provides a convenient tuning reference for the other strings.

2) By means of an electronic tuning aid which is calibrated to set the frequencies of the fundamentals of the open strings, or other selected frequencies, to the values required by the "targeted tuning."

Wound Strings

In order to increase the linear mass density of a string without adding unwanted stiffness, the bass strings of guitars are made by winding a helical external wire on a linear core wire. Because the windings contribute relatively little bending stiffness, the wound string's inharmonicity is less than that of a plain string of equal length and diameter tuned to the same fundamental frequency as the wound string. Therefore, when calculating fret coordinates for wound strings, the actual (measured) diameter of the wound string must be replaced with an equivalent diameter that is either calculated or empirically determined.

Boundary Conditions

Figure 10:
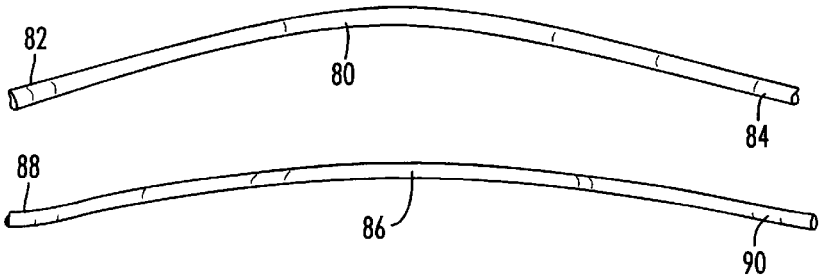
FIG. 10 depicts a fundamental mode for a pinned string (top) and a fundamental mode for a clamped string (bottom).

The exact shape of the deformation of the actual vibrating string is a function of many variables. These include geometric and material properties at the vicinity of both ends of the vibrating length, including those of the finger fretting the string. FIG. 10 shows the upper string hinged at both ends and the lower string clamped at both ends. The most accurate model for actual boundary conditions is to assume a rotational restraint that is neither infinitely flexible (hinge), nor infinitely rigid (clamp). Instead, the fret position for a given frequency can be calculated as a weighted average of the values obtained from these two conditions. For a typical guitar string, the weighting factors may be approximated as 0.7 and 0.3 for clamped and hinged conditions, respectively. The weighting factors may, however, vary from string to string, from fret to fret, or between fretted notes and open strings.

Mechanical Impedance

The above consideration of boundary conditions is for the case when the fret or nut, and the bridge saddle, do not move. Mechanical impedance is defined as the ratio of force to velocity at a point. An immovable object has infinite mechanical impedance at all points. Due to resonances in the guitar body and neck and to their finite mass and stiffness, the boundaries of string vibration (bridge saddle, nut or fret) have a finite mechanical impedance that is a function of frequency.

A consequence of resonances in the body of a musical instrument is repeated cycles of lengthening and shortening of the effective lengths of strings as the frequency is continuously increased. For instruments with relatively rigid construction, such as most solid-body electric guitars, this additional length change is negligibly small. But according to one embodiment of the present invention, fret locations are calculated from fundamental and partial frequencies calculated using the frequency-dependent mechanical impedance. This frequency dependence may be measured, or it may be predicted by common methods of structural dynamics, such as the Finite Element Method.

Figure 2:
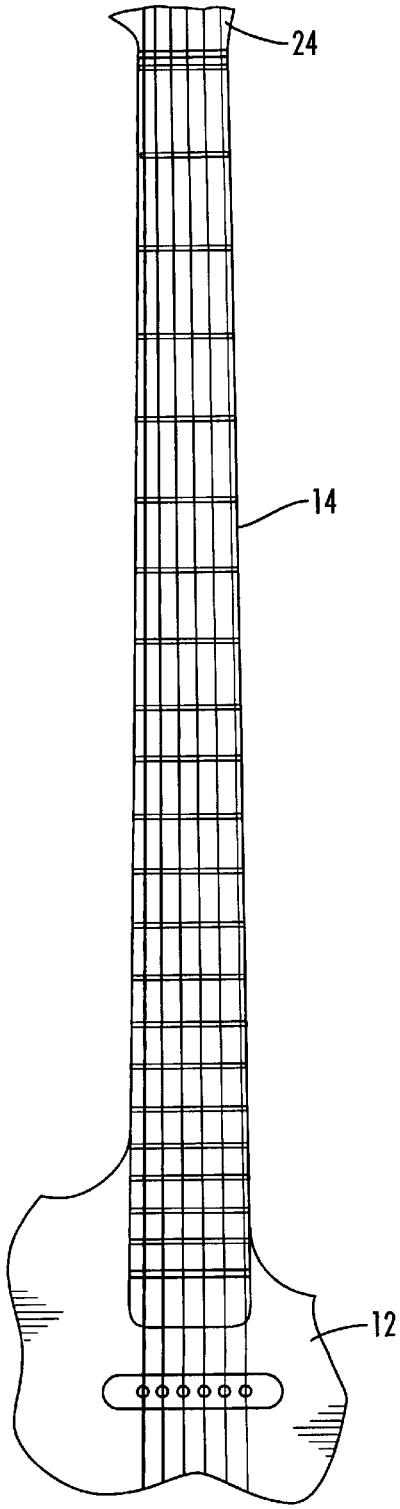
FIG. 2 (PRIOR ART)
FIG. 2 is an enlarged view of the neck of the instrument shown in FIG. 1.
Figure 3:
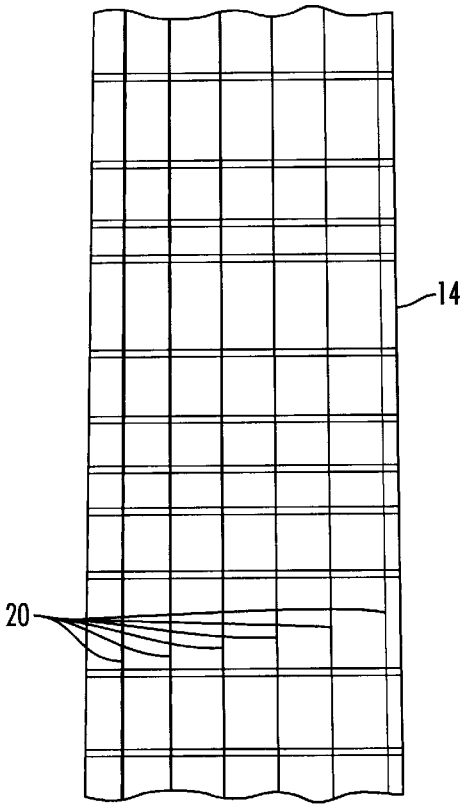
FIG. 3 (PRIOR ART)
FIG. 3 is an enlarged view of a portion of the neck shown in FIG. 2.

FIG. 1 shows a prior art musical instrument 10. The musical instrument 10 shown in FIG. 1 is a six stringed electrical guitar. The musical instrument 10 shown in FIG. 1 includes a body 12, a neck 14 extending from the body 12 and a nut 16 extending transversely across the neck 14. A headstock 24 extends from the neck 14, and is shown in FIG. 1. The stringed musical instrument 10 also includes a bridge 18. A plurality of strings 20 is supported between the nut 16 and the bridge 18. FIG. 1 also shows a plurality of frets 22 extending perpendicular across the neck 14. FIG. 2 is an enlarged view of a portion of the neck 14 of the instrument 10 shown in FIG. 1. FIG. 3 is a larger view of a smaller portion of the neck 14 shown in FIG. 2 to more clearly show orientation of the frets 22.

Figure 4:
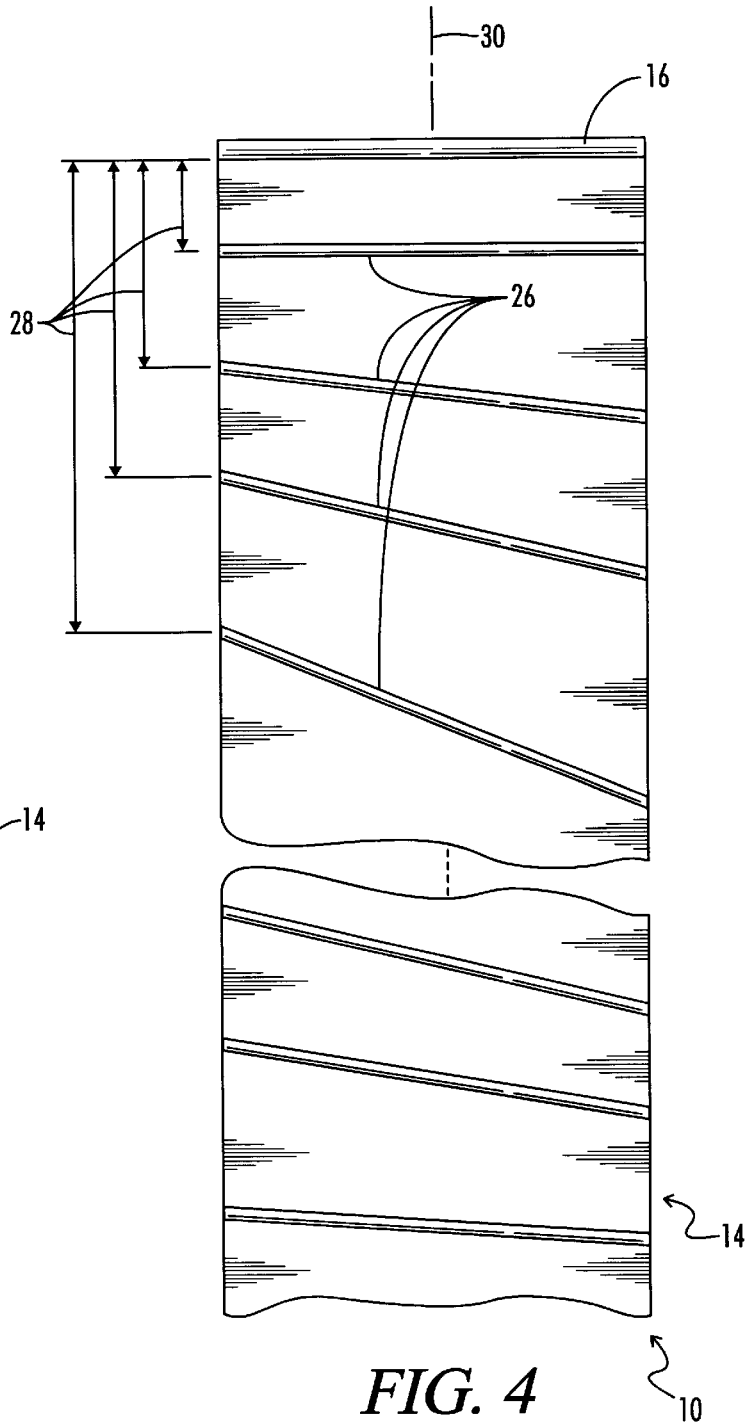
FIG. 4 is an enlarged view showing sections of a neck of a stringed instrument according to the present invention.

The present invention relates to a stringed musical instrument 10 comprising a neck 14. FIG. 4 shows a partial view of the present invention 10. The neck 14 is shown broken. The instrument 10 also includes a nut 16 on the neck 14. It will be apparent to those of skill that the strings are generally supported at the bridge by saddles. Typically, the bridge includes one saddle for each string. These saddles are located at predetermined distances from the corresponding parts of the nut. These distances are in general different for each string. For clarity, the invention is described without reference to saddles, generally. FIG. 4 also shows a plurality of frets 26 spaced along the neck 14 at a respective plurality of distances 28 from the nut 16. In the present invention at least one of the respective plurality of distances 28 from the nut 16 is calculated from a predetermined formula having a stiffness parameter. The stiffness parameter is typically a bending stiffness parameter, or a longitudinal stiffness parameter, or both.

It is noted that when distances, such as distances 28, are defined between two supports such as the nut 16 and one of the frets 26, the distance will be the distance between those points upon the supports which are engaged by the string. For example, depending upon the profile of the nut 16 the string could rest on the centerline, the forward edge, the rear edge or some other point upon the nut 16.

In one preferred embodiment the stiffness parameter includes a modulus of elasticity.

In some embodiments of the musical instrument 10 the neck 14 comprises a central axis 30. The central axis 30 is also referred to herein as a longitudinal axis 30. In a preferred embodiment of the instrument 10 a majority of the plurality of frets 26 are oblique relative to the central axis 30 of the neck 14. As used herein oblique refers to an angle other than 0< or 90° relative to the central axis 30. That is, a fret 26 which is oblique to the central axis 30 is neither parallel nor perpendicular to the central axis 30. It will be understood that a fret 26 at an oblique angle is not parallel to the central axis 30 either. The oblique fret lies at some angle, relative to the central axis between parallel and perpendicular.

Figure 5:
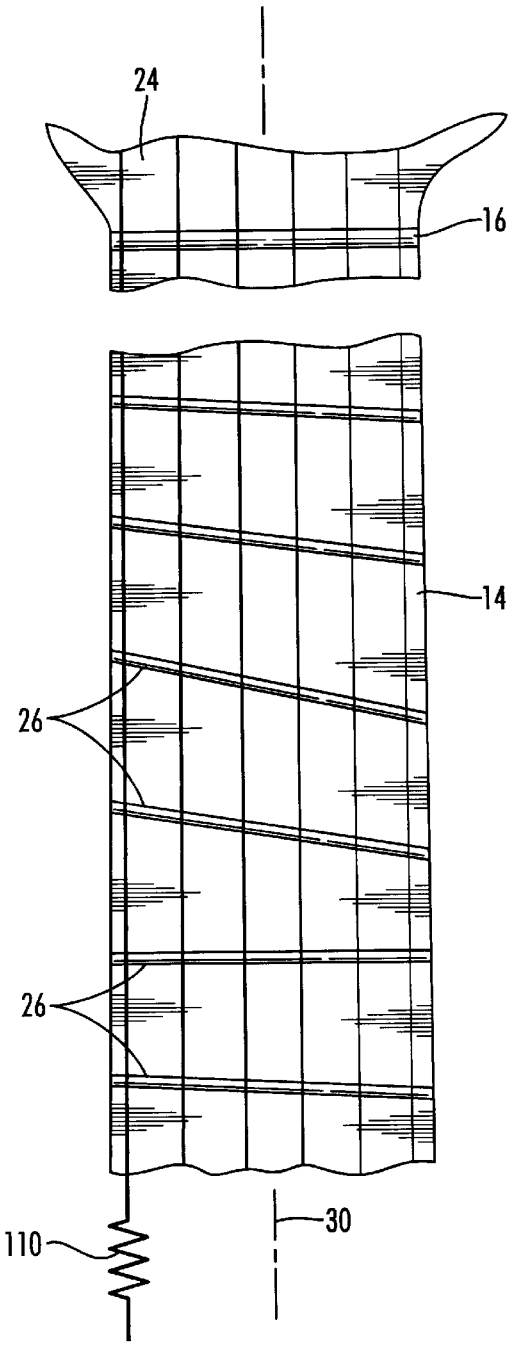
FIG. 5 is a view of a neck similar to the one shown in FIG. 4. Strings of increasing thickness, and corresponding stiffness, are depicted over slanted frets.
Figure 6:
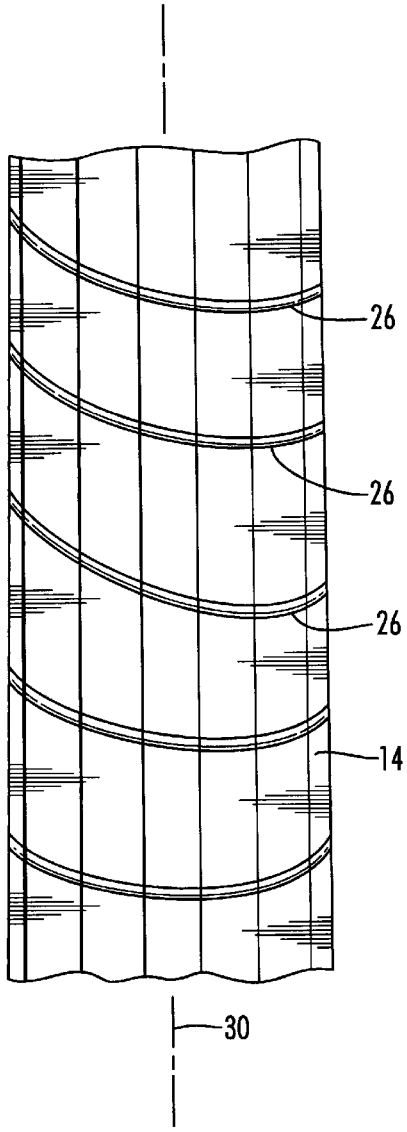
FIG. 6 is a view of a neck similar to the one shown in FIG. 5. However, the frets are curved and slanted.

In some embodiments, the frets 26 are straight. This is shown in FIGS. 4 and 5. However, in other embodiments the frets 26 are curved. This is shown in FIG. 6. It will be apparent to those of skill in the art that the curving of the fret may be in a plane that includes the central axis and at least one of the end points of the frets.

Figure 7:
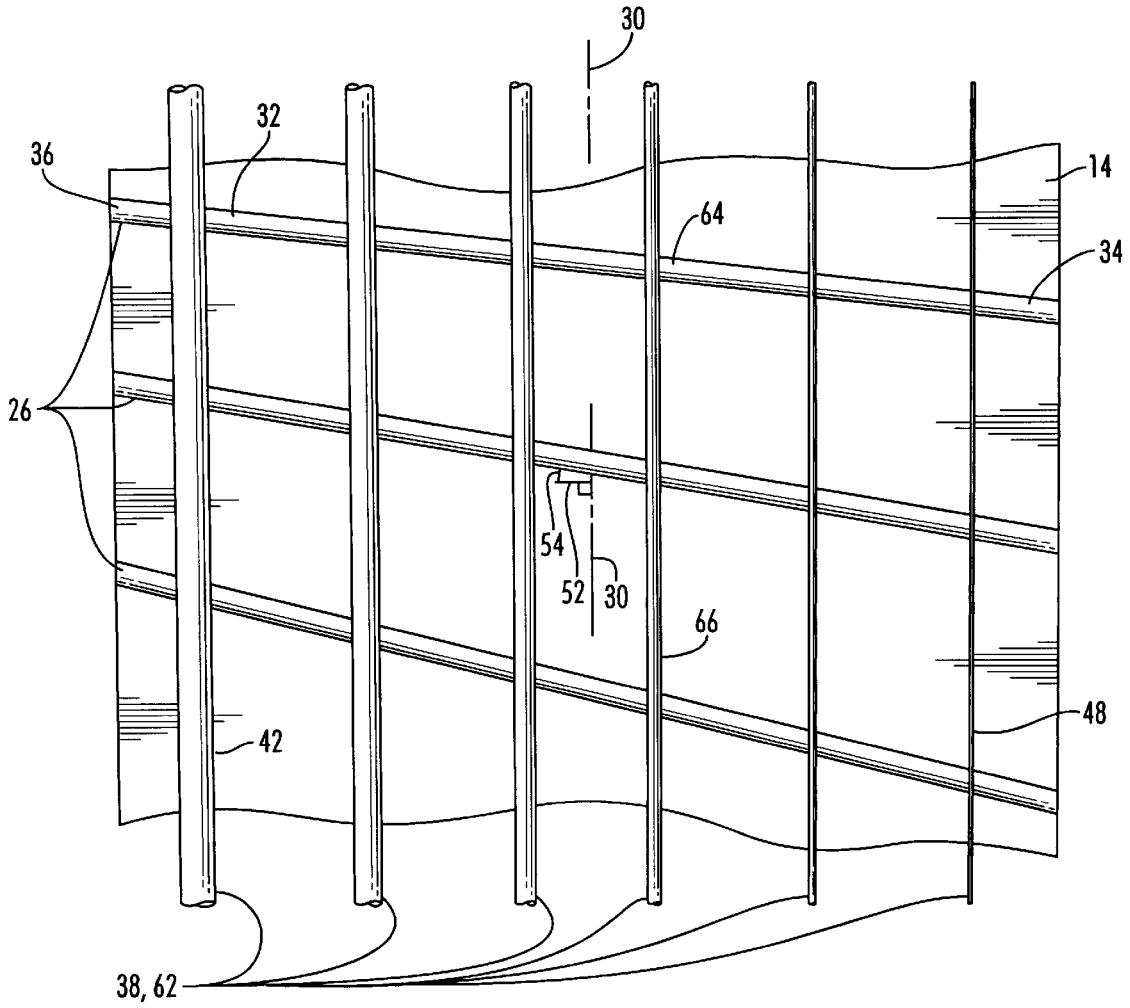
FIG. 7 is an enlarged partial view of a neck with slanted frets. The frets have portions located under each string at respective distances to account for the different stiffnesses of the strings.

FIG. 7 shows an enlarged view of a neck 14 similar to the one shown in FIG. 5. Another embodiment of the present invention is for a stringed instrument 10 comprising a neck 14 and a nut 16 on the neck 14. Referring now to FIG. 7, the instrument 10 includes a plurality of frets 26 spaced along the neck 14. Each fret 26 includes a first portion 32 and a second portion 34. The first portion 32 of at least one 36 of the plurality of frets 26 is spaced a respective first portion distance 44 (not shown in FIG. 7, see FIG. 8) from the nut 16. The respective first portion distance 44 of the at least one fret 36 is calculated from a predetermined formula having a first string stiffness parameter. In some embodiments the stiffness parameter is a bending stiffness, a longitudinal stiffness, or both. The second portion 34 of the at least one 36 of the fret 26 is spaced a respective second portion distance 50 (not shown in FIG. 7, see FIG. 8) from the nut 16. The respective second portion distance 50 of the at least one fret 36 is calculated from a predetermined formula having a second string stiffness parameter.

In the embodiment shown in FIG. 7, at least one fret 36 is straight between the first portion 32 and the second portion 34. In other embodiments, the at least one fret 36 is curved between the first portion 32 and the second portion 34 (see FIG. 6).

The present invention also comprises a method of manufacturing a musical instrument 10 comprising the steps of calculating the desired positions 28 (also referred to as respective distances from the nut) at which to locate the frets 26. The step of calculating is a function of the respective stiffnesses of the respective strings 38. (See FIG. 7). The method also includes the steps of locating the frets 26 at the desired positions.

Lengthening of the string 38 due to its depression to contact the playing fret 26 may be accounted for in the method as well. Likewise, the indentation of the string, or the string profile, by the fretting finger may be taken into account. One may also compensate for non-ideal boundary conditions and finite mechanical impedance at the boundaries.

Generally the method comprises the step of selecting a musical scale the instrument 10 will be adapted to play. In some embodiments the musical scale is a Pythagorean scale. In others the musical scale is a micro-tonal scale or a scale of just intonation. However, most usually the musical scale is an equal-tempered scale. In most preferred embodiments, the musical scale is a twelve-tone-equal tempered scale, or a "stretched" scale approximating a twelve-tone equal-tempered scale.

It will be apparent to those of skill, that respective musical scales for the respective strings 38 may be selected, and that the respective musical scales may be stretched respective amounts. Additionally, the musical scales may be stretched on different portions of the respective strings based upon correspondingly different criteria.

Portions of the respective strings may have fundamentals below a specified frequency, which is in the middle of the instrument's range. An embodiment of the invention may include stretching the musical scales on portions of the respective strings to place partials, which are nominally at the specified frequency, precisely at the specified frequency.

Similarly, portions of the strings may have fundamentals above a specified frequency, which is in the middle of the instrument's range. One embodiment includes stretching the scales on these portions to place the fundamentals at frequencies averaged among those of the partials of notes an octave lower within the span of the fretting hand.

It will also be apparent that the scales may be stretched on portions of the strings at the highest frets. This can be done to place those fundamentals at frequencies which coincide with fundamentals or partials of open strings.

In some embodiments the method further comprises selecting a respective plurality of predetermined frequencies for each respective string 38 such that the instrument 10 is capable of producing notes of the twelve-tone-equal-tempered scale or other scale. As shown in FIG. 7, the step of locating the fret 26 typically comprises locating a respective portion of each fret 26 under each respective string 38 at a distance relative to the nut (see FIG. 8). Each fret 26 is located such that when the respective string 38 is fretted at the respective portion of each fret 26, the respective string 38 will vibrate near one of the respective predetermined frequencies.

Figure 8:
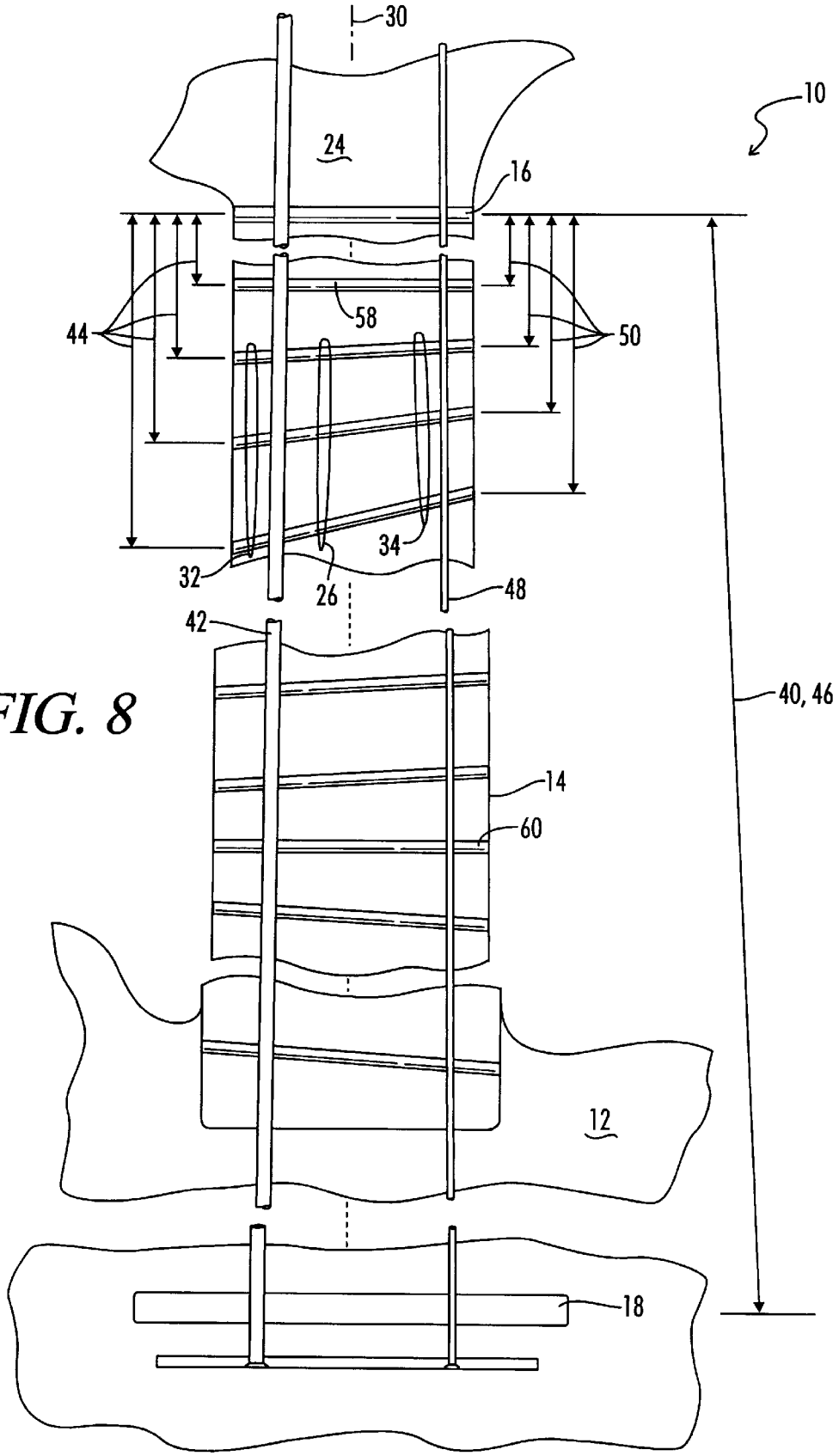
FIG. 8 is a broken view of a neck of an instrument of the present invention. Open-scale lengths and fretted-scale lengths are selected to optimize properties of the string, including stiffness and finger pressure.

Referring to FIG. 8, another method of manufacturing a musical instrument 10 comprises the steps of selecting a musical scale; and calculating an open-scale length 40 for a first real string 42 having a stiffness to produce a first open-scale note of the musical scale. The step of calculating includes solving a formula having a string stiffness parameter and utilizing the first string stiffness value as the value for the stiffness parameter. It will be understood that the stiffness parameter may include bending and longitudinal components (i.e. parameters).

In an another embodiment of the invention, the method comprises the step of calculating a plurality of fretted scale lengths 44 for the first real string 42 to produce a first corresponding plurality of notes of the musical scale. Generally the step of calculating the fretted scale lengths 44 includes solving the formula utilizing the first string stiffness parameter as the value for the stiffness parameter. The method also comprises the step of locating a respective plurality of frets 26 at the first string fretted scale lengths 44.

As will be apparent to those of skill in the art the method also comprises the step of calculating an open-scale length 46 for a second real string 48 having a stiffness to produce a second open-scale note of the musical scale. Typically, the step of calculating includes solving the formula utilizing the second string stiffness value as the value for the stiffness parameter. The method also includes calculating a plurality of fretted scale lengths 50 for the second real string 48 to produce a second corresponding plurality of notes of the musical scale. The step of calculating the fretted scale lengths 50 includes solving the equation utilizing the stiffness value of the second real string 48 as the value of the stiffness parameter.

In one embodiment, the method comprises the steps of providing a plurality of frets 26 having respective first 32 and second 34 portions. The method includes locating the respective first portions 32 of the frets 26 under the first string 42 at the fretted scale lengths 44; and locating the respective second portions 34 of the frets 26 under the second string 48 at the fretted scale lengths 50.

As shown in FIG. 7, one embodiment of the method comprises the step of maintaining the frets 26 in respective straight lines between the respective first portions 32 and second portions 34. This is also shown in FIG. 8. FIG. 8 depicts a method which includes the step of orienting a majority of the frets 26 obliquely relative to the central axis 30 of the neck 14.

Another embodiment of the present invention includes the step of minimizing a maximum fret angle relative to a line perpendicular to the central axis. FIG. 7 shows a fret angle 54 relative to a line 52 perpendicular to the central axis 30. In one embodiment the step of minimizing a maximum value of the fret angle 54, also referred to as the maximum angle, comprises the step of orienting at least two frets parallel to each other. In FIG. 8 fret 58 and 60 are two frets parallel to each other. Preferably the step of minimizing the maximum angle comprises orienting two interior frets parallel to each other. Interior fret is intended to mean other than the first fret adjacent the nut 16 or the last fret spaced away from the nut 16 (e.g. the furthest adjacent fret, with frets between the last fret and the first fret). In some embodiments the method comprises the step of orienting the two parallel frets 58 and 60 perpendicular to the central axis 30 of the neck 14. In FIG. 8 frets 58 and 60 are shown perpendicular to the central axis 30. In some embodiments the method comprises the step of curving the frets. This is shown in FIG. 6. It will be apparent to those of skill in the art that the step of curving the frets 26 comprises the step of curving the frets through a plurality of third string fretted scale lengths.

Another embodiment of the invention comprises the method of manufacturing a musical instrument 10 comprising the steps of utilizing real strings 62 having real stiffnesses. See FIG. 7 in which the respective strings 38 are real strings 62. The method includes calculating the desired positions at which to locate the frets 26 utilizing a formula accounting for the real stiffnesses of the real strings 62. The method includes locating the frets 26 at the desired positions. As shown in FIG. 7 the method may include a step of slanting a plurality of frets 26 relative to the central axis 30 of the neck 14.

One embodiment of the present invention includes a stringed musical instrument 10 comprising a neck 14 having a longitudinal axis 30; a plurality of frets 26 oblique relative to the longitudinal axis 30 and a nut 16 perpendicular to the longitudinal axis 30 of the neck 14. This is an embodiment similar to the one shown in FIG. 5. Referring to FIG. 8, the instrument 10 may comprise a fret 60 perpendicular to the longitudinal axis 30 of the neck. In some embodiments, as shown in FIG. 8 the fret 60 is the last fret 60 perpendicular to the longitudinal axis 30 of the neck 14.

In some embodiments of the instrument 10 the plurality of frets 26 is located a plurality of predetermined distances 28 from the nut 16. The distances 28 are determined for representative real strings 62 having stiffnesses. Typically the real strings have both bending and longitudinal stiffnessess. Generally the predetermined distances 28 are determined to produce notes of a predetermined scale. As has been mentioned, the instrument 10 may comprise two parallel frets. In FIG. 8, the two parallel frets are 58 and 60. Also, as is the case shown in FIG. 8, the two parallel frets may be perpendicular to the longitudinal axis 30 of the neck 14. Also, as shown in FIG. 8, the two parallel frets may be the first fret 58 adjacent to the nut 16 and the last fret 60 away from the nut 16.

Figure 11:
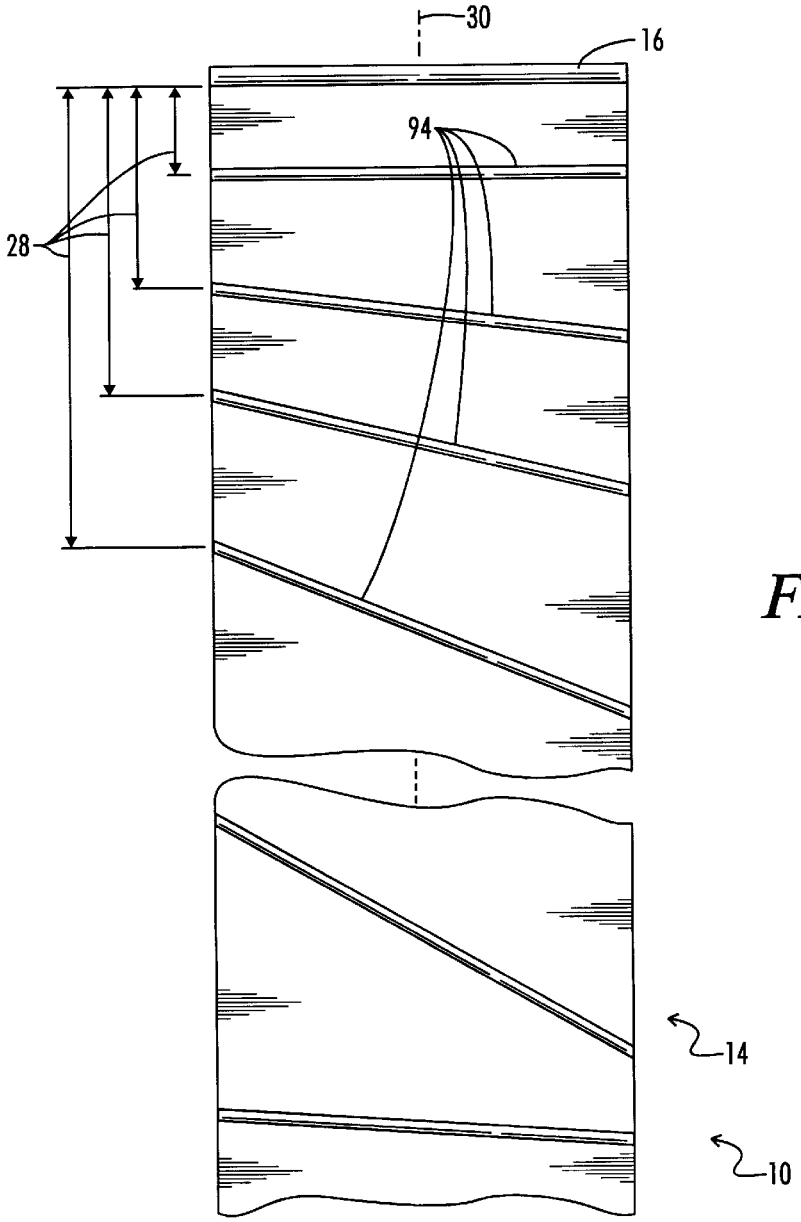
FIG. 11 is similar to FIG. 4. The frets are shown fanned.

The present invention also includes a stringed musical instrument 10 comprising a neck 14 having a longitudinal axis 30; and a plurality of fanned frets 94 across the neck 14. See FIGS. 4 and 11; FIG. 11 is similar to FIG. 4, however, the frets are shown fanned. A majority of the fanned frets 94 are oblique relative to the longitudinal axis 30 of the neck 14. The fanned frets 94 shown are substantially similar to the frets 26. Generally the reference numbers 94 and 26 may be interchanged when discussing fanned frets. FIG. 8 shows an embodiment wherein at least two of the fanned frets 26 are parallel to each other. In some embodiments the two parallel fanned frets are perpendicular to the longitudinal axis 30 of the neck 14.

As will be apparent to those of skill in the art, the fanned frets 26 may be curved, as in FIG. 6.

FIG. 8 shows an embodiment wherein the nut 16 is perpendicular to the longitudinal axis 30.

Figure 9:
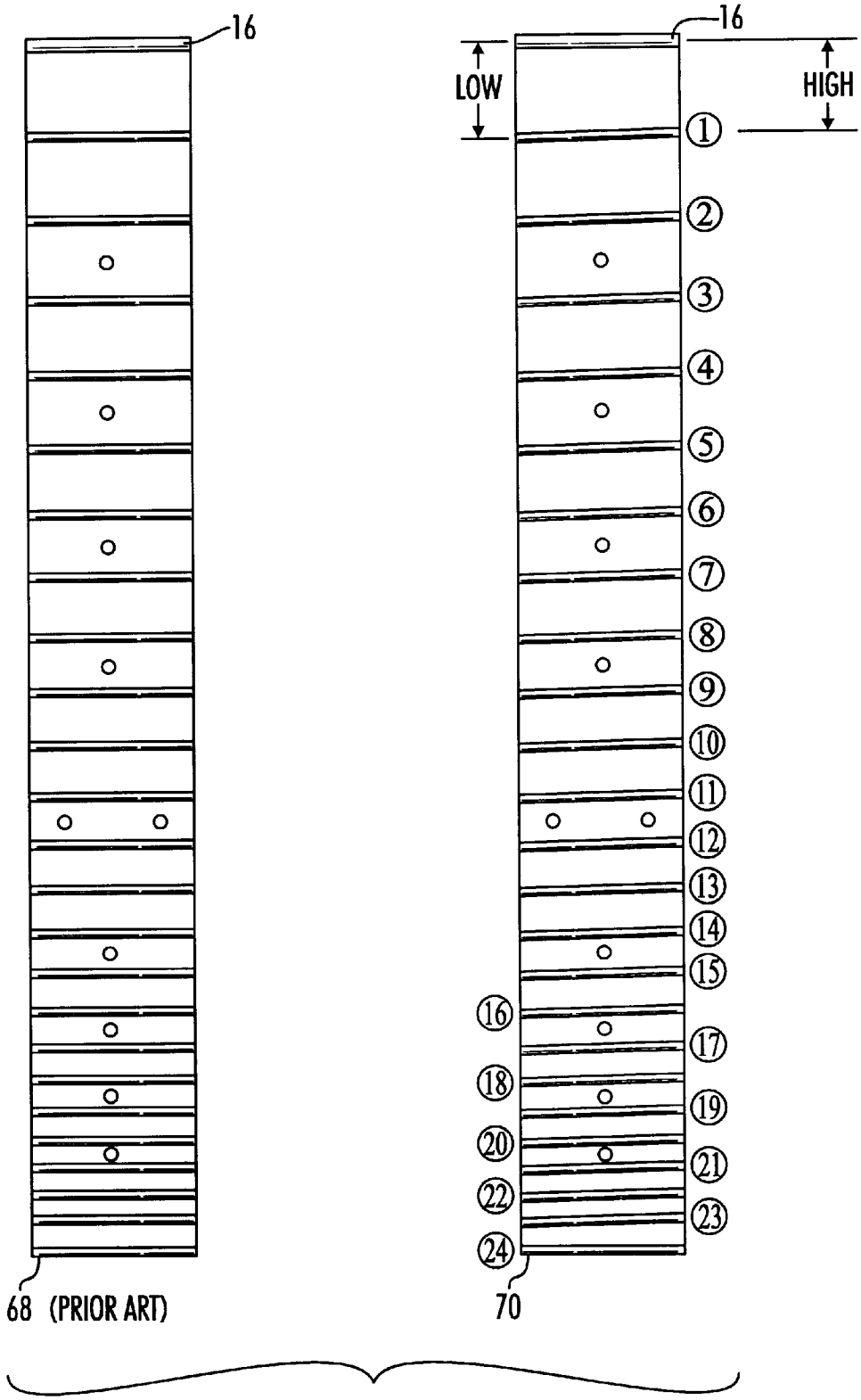
FIG. 9 shows a conventional fretboard having parallel frets compared to a fret board according to the present invention. The frets are positioned for steel strings having 0.010 inch thickness for the high-E string (right side) and 0.045 inch thickness for the low-E string (left side).

FIG. 9 shows a comparison between a conventional neck division and a neck division according to one embodiment of the present invention.Both fingerboards are for a nominally 628 mm scale. In FIG. 9 the fingerboard 70 comprises twenty-four (24) frets denoted by their fret numbers enclosed in circles. Each fret shown in fingerboard 70 includes a low side and a high side. The low side is calculated for a wound low-E string having a diameter of 0.046 inch, a steel core of 0.018 inch effective diameter, and a linear mass density of 0.0064 kg/m. The high side is calculated for a plain high-E string made of steel having a diameter of 0.010 inch. The distances from the low-E side and the high-E side of each fret to the corresponding side of the nut 16 are shown in Table 2 below. The fret slant is the difference between the low-E side and the high-E side. Table 2 and FIG. 9 are for one embodiment of the present invention where the nut and the $24^{th}$ fret are made straight and parallel. In this design, the length compensations are 1.3 mm and 0.1 mm, for the low-E and high-E strings, respectively. The neck design depicted in FIG. 9 and Table 2 is only an illustrative example of one of many embodiments of the present invention. In general, when designing the neck to compensate for tension increase from fretting, according to the present invention the longitudinal fret coordinates (Table 2) and the plan view of frets (FIG. 9) would depend on the action profile. In this illustrative example conventional action is assumed and tension increase from fretting is not compensated. As a result, with a straight neck the optimal length compensations would slightly differ from the values given above, depending on action height.

TABLE 2

| Distance From Nut in mm | | Fret Number | |
|---|---|---|---|
| Low-E String | High-E String | (Nut = 0) | Fret Slant in mm |
| 0.000 | 0.000 | 0 | 0.000 |
| 35.289 | 35.251 | 1 | 0.038 |
| 68.595 | 68.524 | 2 | 0.071 |
| 100.030 | 99.928 | 3 | 0.102 |
| 129.699 | 129.570 | 4 | 0.129 |
| 157.700 | 157.548 | 5 | 0.152 |
| 184.128 | 183.956 | 6 | 0.172 |
| 209.070 | 208.881 | 7 | 0.189 |
| 232.610 | 232.407 | 8 | 0.202 |
| 254.826 | 254.613 | 9 | 0.213 |
| 275.792 | 275.571 | 10 | 0.220 |
| 295.578 | 295.354 | 11 | 0.225 |
| 314.251 | 314.025 | 12 | 0.226 |
| 331.873 | 331.649 | 13 | 0.224 |
| 348.502 | 348.282 | 14 | 0.219 |
| 364.194 | 363.982 | 15 | 0.211 |
| 379.001 | 378.801 | 16 | 0.201 |
| 392.973 | 392.787 | 17 | 0.187 |
| 406.157 | 405.988 | 18 | 0.170 |
| 418.596 | 418.447 | 19 | 0.149 |
| 430.333 | 430.207 | 20 | 0.126 |
| 441.405 | 441.306 | 21 | 0.099 |
| 451.851 | 451.781 | 22 | 0.070 |
| 461.705 | 461.669 | 23 | 0.037 |
| 471.000 | 471.000 | 24 | 0.000 |

FIG. 9 also illustrates a fingerboard 70 that accommodates steel strings of different diameters on opposite sides of the fingerboard 70. With the assumption that the intermediate strings (See FIGS. 7 and 8) in a matched set of strings are manufactured with specific diameters to accommodate this scheme, the frets can be straight lines as depicted in FIG. 7. Optionally, or additionally, springs can be utilized and varied to reduce the effective longitudinal stiffness of some or all strings.

The present invention also encompasses a fingerboard 70 (See FIG. 9) for a musical instrument 10. The fingerboard 70 comprising a longitudinal axis 30; and a plurality of frets 26. (See drawings depicting the musical instrument 10). Each fret 36 has a first portion 32 located at a predetermined distance 28 relative to a nut 16 of the musical instrument 10. The predetermined distances 28 are calculated for a first real string 42 having a stiffness such that the first real string 42 will produce notes of a predetermined scale.

Generally each fret 36 of the plurality of frets 26 has a second portion 34 located at another predetermined distance to the nut 16. The other predetermined distances are calculated for a second real string 48 having a stiffness such that the second real string 48 will produce notes of the predetermined scale. With reference to FIG. 8, the predetermined distances of the first portion are denoted 44 and the predetermined distances of the second portion are denoted 50. As shown in FIG. 7 and FIG. 8 the stiffness of the second string 48 is less than the stiffness of the first real string 42. This is indicated by the relative thicknesses of the strings. Typically, the stiffnesses of the first and second real strings include corresponding bending stiffness components.

Typically, each fret 36 of the plurality of frets 26 has a third portion 64 between the first portion 32 and the second portion 34. Yet another predetermined distance relative to the nut 16 (not shown) for each fret 36 is calculated for a third real string 66 (shown in FIG. 7) having a stiffness such that the third real string 66 will produce notes of the predetermined scale. Also, as shown in FIG. 7, the stiffness of the third string 66 is intermediate between the stiffness of the first real string 42 and stiffness of the second real string 48.

In one embodiment of the fingerboard, each fret 36 is straight from the first portion 32 to the second portion 34. However, as FIG. 6 shows, each fret may be curved. A fret may have different portions which are straight and curved; some frets may be straight and others curved or curved in part. Each third portion 64 may be located at another predetermined distance corresponding to the third real string 66 and the fret third portion 64 may be curved through the yet another predetermined distance.

It will be apparent to those with skill in the art that the present invention also includes a method of producing notes of a musical scale. The method comprises the steps of selecting a musical scale; stringing a musical instrument 10 with a real string 42; and locating a plurality of frets 26 under the real string 42. The frets are located such that when the real string 42 is depressed at one of the frets 26 and plucked, the real string 42 will produce a note of the musical scale. The step of locating the frets 26 includes calculating respective distances 28 (See FIG. 4) relative to the nut 16 with a formula having a stiffness parameter equal to the stiffness parameter of a real string 42. It will be apparent that the stiffness parameter may include bending and longitudinal components.

Another method of the present invention for producing notes of a musical scale which comprises the step of calculating includes accounting for the stiffness parameter of the real string. As will be apparent to those of skill, use of the singular includes the plural where appropriate. The method of course includes depressing the real string at one of the locations; and vibrating the real string.

It will be apparent that the present invention includes a method of achieving accurate tuning of a stringed instrument. The method may comprise selecting a predetermined musical scale; and positioning the frets under each real string to account for a respective stiffness of each string.

It will also be apparent that the method may further comprise the step of locating the frets so as to compensate for tension increase due to depression of the string to contact the playing fret. Likewise the method may further comprise the step of locating frets so as to compensate for tension increase due to indention of the string by a fretting finger.

The method may also further comprise the step of locating frets to compensate for non-ideal boundary conditions.

Additionally, the method may further comprise the step of changing the effective longitudinal stiffness of the string by adding a spring in series with the string. A spring 110 is schematically shown in FIG. 5. Similarly, the method may further comprise the step of selecting the longitudinal profile of the neck so as to compensate for the tension increase that results from fretting the string.

Some embodiments comprise the step of adjusting the frequency of the vibration of the string with a servomechanism, wherein the servomechanism responds to the fret in use and frequencies of partials produced, and adjusts string tension.

FIG. 10 depicts a fundamental mode for a first real string 80 that is simply supported (i.e. pinned or hinged) at its ends 82 and 84. The fundamental mode for a second real string 86 that is clamped at its ends 88 and 90 is also shown in FIG. 10.

NUMERICAL EXAMPLES

The following example is intended to serve as an illustration of the magnitude of intonation errors caused by string stiffness and geometric neck division on a typical prior-art electric guitar:

Steel has an elastic modulus of 207 Gigapascals (30 Million pounds force per square inch). The density of steel is 7800 kg/m$^3$. This results in the linear mass of a typical G-string with a 0.43 mm (0.017 inch) diameter being 0.00115 kg/m (0.000064 pounds mass per inch). With approximately 628 mm. (24.75 inch) scale length, the tension required to tune this G-string to the standard pitch of 196 Hz. is approximately 70 Newtons (16 pounds force). When the string is stopped, for example at the 12$^{th}$ fret, its free length becomes approximately 314 mm (12.375 inches). Substituting these values in Equation (2a) and (5) for clamped boundaries, we obtain $$\frac{f_{12}^{string}}{f_{12}^{cable}} = \frac{392.4}{392} = 1.001$$

In musical terms, this 0.1% pitch increase caused by string stiffness is equivalent to the stiff string's pitch being 1.7 cents sharp at the 12$^{th}$ fret (octave) relative to that of an ideal string or cable. At higher frets the error is greater. For example, at the 17$^{th}$ fret the error is 3.5 cents. Cent is the musical unit for measuring relative pitch. One cent equals $1/1200$ of an octave. It is generally accepted that pitch errors greater than 3 cents are audible when they are heard sequentially. When notes are played simultaneously, much smaller pitch errors also become audible.

At higher frets, as the free length of the string decreases, pitch error grows rapidly. For example at the 24$^{th}$ fret, the error rises to 8.5 cents.

This drawback of prior-art neck division is partly remedied either by a fixed bridge that is angled relative to the strings or with individually adjustable bridge saddles. In either case, strings with larger diameter are given a longer open-string length than strings with smaller diameter. For wound strings the relevant diameter is the effective core diameter, which may be measured or calculated, and is always somewhat larger than the actual core diameter since the winding contributes some stiffness.

Lengthening the open string by adjusting the bridge allows the intonation error to be cancelled at a given fret. With the Gstring used in the above example, using prior-art neck division, the length of the open string would be increased by a small amount that is in practice determined empirically. With a corresponding increase in tension, the open string would again be tuned to standard pitch, but the 1.7 cent error at the $12^{th}$ fret could be completely removed. However, since the frets were located for the original 628 mm scale, this length compensation would affect all frets relative to the nut and relative to each other. When the string length is increased at the bridge, the frequency of any fret decreases approximately in proportion to that fret's distance from the nut. In the above example of a G-string of 0.017" diameter, the $12^{th}$ fret would have perfect intonation if the bridge were moved by 0.6 mm, increasing the open string length from 628 mm to 628.6 mm. A corresponding increase in string tension would allow the string to have standard pitch with the open string and also with the $12^{th}$ fret. Frets below the $12^{th}$ fret would then be flat by a very small amount, and the intonation error that is left at higher frets would be considerably reduced.

As convenient as this method may be, the frequency compensation thus achieved cannot be exact for more than one of the frets. In our example with the length compensation adjusted for exact compensation at the $12^{th}$ fret (i.e., 0.6 mm), the $24^{th}$ fret, for example, would be 3.3 cents sharp.

Instead of the $12^{th}$ fret, another, and possibly higher fret could be chosen at which to cancel the error. But then the octave ($12^{th}$ fret) would be flat. This numerical example demonstrates that with length compensation alone, it is not possible to cancel the intonation error at more than one fret for each string.

Table 3 lists for each fret, the amount of calculated frequency error caused by the bending stiffness of the G-string used in the above example before and after intonating the instrument for an exact octave at the $12^{th}$ fret. Frequency error is defined here as the departure from equal temperament based on open string frequency. It should be noted that with strings of larger diameter, the frequency errors resulting from string stiffness are greater than those shown in Table 3, below. Frequency shifting due to tension increase that results from fretting which will be discussed shortly, is not included in these calculations. A nominal scale length of 628 mm is assumed.

TABLE 3

| Fret number | Error (cents) before intonation | Error (cents) after intonation |
|---|---|---|
| 0 | 0.0 | 0.0 |
| 1 | 0.1 | 0.0 |
| 2 | 0.1 | −0.1 |
| 3 | 0.2 | −0.1 |
| 4 | 0.3 | −0.1 |
| 5 | 0.4 | −0.1 |
| 6 | 0.6 | −0.1 |
| 7 | 0.7 | −0.1 |
| 8 | 0.9 | −0.1 |
| 9 | 1.0 | −0.1 |
| 10 | 1.2 | −0.1 |
| 11 | 1.5 | −0.1 |
| 12 | 1.7 | 0.0 |
| 13 | 2.0 | 0.1 |
| 14 | 2.3 | 0.2 |
| 15 | 2.6 | 0.3 |

TABLE 3-continued

| Fret number | Error (cents) before intonation | Error (cents) after intonation |
|---|---|---|
| 16 | 3.0 | 0.4 |
| 17 | 3.5 | 0.6 |
| 18 | 4.0 | 0.8 |
| 19 | 4.5 | 1.1 |
| 20 | 5.1 | 1.4 |
| 21 | 5.8 | 1.8 |
| 22 | 6.6 | 2.2 |
| 23 | 7.5 | 2.7 |
| 24 | 8.5 | 3.3 |

It should be evident that placing the frets optimally with respect to the bending stiffness of a particular string can eliminate intonation errors caused by the bending stiffness of that particular string. However, another string with a different section modulus would still be tempered differently. Dividing the neck of a guitar according to Equation (5) for all strings according to each string's section modulus results in a neck design where the frets in general are not parallel to each other.

FIG. 9 illustrates a guitar neck that accommodates steel strings of different diameters on opposite sides of the neck. With the assumption that the intermediate strings in a matched set of strings are manufactured with specific diameters to accommodate this scheme, the frets can be straight lines as depicted in FIG. 9. It should be evident that, even when using ordinary sets of strings, intermediate strings in a set would have intermediate stiffness properties. As a consequence, a neck division according to this invention can reduce intonation errors that would result from string stiffness even with conventional sets of strings. These errors can be eliminated only with a calibrated and matched set of strings, however.

In order to accommodate strings of arbitrary diameters and stiffness properties chosen by other criteria, the frets must be curved as illustrated in FIG. 6. The distances from the bridge of 6 points along the length of each fret (one point for each string on a 6-string guitar) is determined from equation (5). Subsequently, the shape of each fret is determined as a smooth curve that passes through these 6 points.

It should be evident that even with strings that are not specifically matched, since intermediate strings have intermediate stiffness properties, frets that are manufactured as angled straight lines according to this invention will reduce intonation errors that would result from having made the frets parallel to each other.

Thus, although particular embodiments of the present invention have been described, it is not intended that such references be construed as limitations upon the scope of this invention except as set forth in the following claims.

What is claimed is:

1. A stringed musical instrument comprising:

a neck;

a nut on the neck; and a plurality of frets spaced along the neck at a respective plurality of distances from the nut, wherein at least one of the respective plurality of distances from the nut is calculated from a predetermined formula having a string stiffness parameter.

2. The instrument of claim 1, wherein the string stiffness parameter includes a modulus of elasticity.

3. The instrument of claim 1, wherein the neck comprises a central axis, and wherein a majority of the plurality of frets are oblique relative to the central axis of the neck.

4. The instrument of claim 3, wherein the frets are straight.

5. The instrument of claim 3, wherein the frets are curved.

6. A stringed musical instrument comprising:

a neck;

a nut on the neck;

a plurality of frets spaced along the neck, wherein each fret includes a first portion and a second portion; and wherein the first portion of at least one of the plurality of frets is spaced a respective first portion distance from the nut, wherein the respective first portion distance of the at least one fret is calculated from a predetermined formula having a first string stiffness parameter, and the second portion of the at least one of the frets is spaced a respective second portion distance from the nut, wherein the respective second portion distance of the at least one fret is calculated from a predetermined formula having a second string stiffness parameter.

7. The instrument of claim 6, wherein the at least one fret is straight between the first portion and the second portion.

8. The instrument of claim 6, wherein the at least one fret is curved between the first portion and the second portion.

9. A method of manufacturing a fretted stringed musical instrument comprising the steps of:

calculating the desired positions at which to locate the frets, wherein the step of calculating is a function of the respective stiffnesses of the respective strings; and locating the frets at the desired positions.

10. The method of claim 9, comprising the step of selecting a musical scale the instrument will be adapted to play.

11. The method of claim 10, wherein the musical scale is a Pythagorean scale.

12. The method of claim 10, wherein the musical scale is an equal-tempered scale.

13. The method of claim 10, wherein the musical scale is a micro-tonal scale.

14. The method of claim 10, wherein the musical scale is a 12-tone-equal tempered scale.

15. The method of claim 10, wherein the musical scale is a stretched scale.

16. The method of claim 10, further comprising the step of accounting for lengthening of the string due to its depression to contact the playing fret.

17. The method of claim 10, further comprising the step of accounting for indentation of the string profile by the fretting finger.

18. The method of claim 10, further comprising the step of accounting for non-ideal boundary conditions.

19. The method of claim 10, further comprising:

selecting a respective plurality of predetermined frequencies for each respective string such that the instrument is capable of producing notes of the selected musical scale; and wherein the step of locating the frets comprises locating a respective portion of each fret under each respective string at a distance relative to the nut such that when the respective string is fretted at the respective portion of each fret the respective string will vibrate near one of the respective predetermined frequencies.

20. The method of claim 9, further comprising selecting respective musical scales for the respective strings and stretching the respective musical scales respective amounts.

21. The method of claim 9, further comprising stretching musical scales on different portions of the respective strings based on correspondingly different criteria.

22. The method of claim 9, wherein portions of the respective strings have fundamentals below a specified frequency in the middle of the instrument's range and where the method includes stretching the musical scales on portions of the respective strings to place partials nominally at the specified frequency precisely at the specified frequency.

23. The method of claim 9, comprising the step of stretching scales on portions of the respective strings whose fundamentals are above a specified frequency in the middle of the instrument's range to place fundamentals at frequencies averaged among those of the partials of notes an octave lower within the span of the fretting hand.

24. The method of claim 10, further comprising the step of stretching scales on portions of the respective strings at the highest frets to place those fundamentals at frequencies which coincide with partials of open strings.

25. A method of manufacturing a musical instrument comprising the steps of:

selecting a musical scale; and calculating an open-scale length for a first real string having a stiffness to produce a first open-scale note of the musical scale, wherein the step of calculating includes solving a formula having a string stiffness parameter and utilizing the first string stiffness as a value for the stiffness parameter.

26. The method of claim 25, wherein the stiffness parameter includes a bending stiffness component.

27. The method of claim 25, wherein the stiffness parameter includes a longitudinal stiffness component.

28. The method of claim 25, wherein the step of calculating comprises compensating for increase in tension due to depression of the string to contact the playing fret.

29. The method of claim 25, wherein the step of calculating comprises compensating for non-ideal boundary conditions.

30. The method of claim 25, comprising the step of calculating a plurality of fretted-scale lengths for the first real string to produce a first corresponding plurality of scale notes of the musical scale, wherein the step of calculating the fretted-scale lengths includes solving the formula utilizing the first string stiffness parameter as the value for the stiffness parameter.

31. The method of claim 30, comprising the step of locating a respective plurality of frets at the first string fretted-scale lengths.

32. The method of claim 30, comprising the steps of:

calculating an open-scale length for a second real string having a stiffness to produce a second open-scale note of the musical scale, wherein the step of calculating includes solving the formula utilizing the second string stiffness parameter as the value for the stiffness parameter; and calculating a plurality of fretted-scale lengths for the second real string to produce a second corresponding plurality of scale notes of the musical scale, wherein the step of calculating the fretted-scale lengths includes solving the formula utilizing the stiffness parameter of the second real string as the value for the stiffness parameters.

33. The method of claim 32, comprising the steps of:

providing a plurality of frets having respective first and second portions;

locating the respective first portions of the frets under the first string at the first string fretted-scale lengths; and locating the respective second portions of the frets under the second string at the second string fretted-scale lengths.

34. The method of claim 33, comprising the step of maintaining the frets in respective straight lines between the respective first portions and second portions.

35. The method of claim 34, comprising the step of orienting a majority of the frets obliquely relative to the central axis of the neck.

36. The method of claim 34, comprising the step of minimizing a fret angle measured relative to a line perpendicular to the central axis.

37. The method of claim 36, wherein the step of minimizing the fret angle comprises the step of orienting at least two frets parallel to each other.

38. The method of claim 37, comprising the step of orienting the two parallel frets perpendicular to the central axis of the neck.

39. The method of claim 33, comprising the step of curving the frets.

40. The method of claim 39, wherein the step of curving the frets comprises the step of curving the frets through a plurality of third string fretted-scale length locations.

41. A method of manufacturing a musical instrument comprising the steps of:

utilizing real strings having real stiffnesses;

calculating the desired positions at which to locate the frets utilizing a formula accounting for the real stiffnesses of the real strings; and locating the frets at the desired positions.

42. The method of claim 41, comprising the step of slanting a plurality of the frets relative to the central axis of the neck.

43. A stringed musical instrument comprising:

a neck having a longitudinal axis;

a plurality of frets that are oblique relative to the longitudinal axis of the neck; and a nut perpendicular to the longitudinal axis of the neck.

44. The instrument of claim 43, comprising a fret perpendicular to the longitudinal axis of the neck.

45. The instrument of claim 43, comprising a last fret perpendicular to the longitudinal axis of the neck.

46. The instrument of claim 43, wherein the plurality of frets are located at a plurality of predetermined distances relative to the nut, and wherein the predetermined distances are determined for a representative real string having a stiffness.

47. The instrument of claim 46, wherein the predetermined distances are determined to produce notes of a predetermined scale.

48. The instrument of claim 43, comprising two parallel frets on the neck.

49. The instrument of claim 48, wherein the two parallel frets are perpendicular to the longitudinal axis of the neck.

50. The instrument of claim 49, wherein the two parallel frets comprise the first fret adjacent to the nut and the last fret spaced away from the nut.

51. A stringed musical instrument comprising:

a neck having a longitudinal axis; and a plurality of frets fanned across the neck, wherein a majority of the fanned frets are oblique relative to the longitudinal axis of the neck, and wherein at least two of the fanned frets are parallel to each other and wherein the two parallel fanned frets are perpendicular to the longitudinal axis of the neck.

52. The instrument of claim 51, wherein at least one of the fanned frets is parallel to the nut.

53. The instrument of claim 52, wherein the at least one of the fanned frets that is parallel to the nut is one of the two of the fanned frets that are parallel to each other.

54. The instrument of claim 52, wherein the nut is perpendicular to the longitudinal axis of the neck.

55. A method of producing notes of a musical scale comprising the steps of:

selecting a musical scale;

stringing a musical instrument with a real string;

locating a plurality of frets under the real string such that when the real string is depressed at one of the frets and plucked, the real string will produce a note of the musical scale, wherein the step of locating the frets includes calculating respective distances relative to the nut with a formula having a stiffness parameter equal to a stiffness parameter of the real string; and plucking the real string.

56. A method of producing notes of a musical scale comprising the steps of:

selecting a musical scale;

calculating a plurality of locations to depress a real string having a stiffness, wherein the step of calculating includes accounting for the stiffness of the real string;

depressing the real string at one of the locations; and vibrating the real string.

57. A method of achieving accurate tuning of a stringed instrument comprising the steps of:

selecting a predetermined musical scale; and positioning the frets under each string to account for a respective stiffness of each string.

58. The method of claim 57, further comprising the step of locating the fret positions to compensate for tension increase due to depression of the string to contact the playing fret.

59. The method of claim 57, further comprising the step of locating fret positions to compensate for tension increase due to indention of the string by a fretting finger.

60. The method of claim 57, further comprising the step of locating the fret positions to compensate for non-ideal boundary conditions.

61. The method of claim 57, further comprising the step of locating the longitudinal stiffness of the string by adding a spring in series with the string.

62. The method of claim 57, further comprising the step of modifying the longitudinal profile of the neck to control the tension increase of the string.

63. The method of claim 57, further comprising the step of adjusting the frequency of the vibration of the string with a servomechanism, wherein the servomechanism responds to the fret in use.

64. A method of manufacturing a musical instrument comprising the steps of:

calculating the desired positions at which to locate the frets, wherein the step of calculating is a function of the respective stiffnesses of the respective strings;

locating the frets at the desired positions;

selecting a musical scale the instrument will be adapted to play;

accounting for tension increase due to depressing strings to contact the playing frets.

65. The method of claim 64, comprising the step of accounting for the decrease in linear mass density due to lengthening of the strings.

66. A stringed musical instrument, comprising:

a neck;

a nut on the neck;

a bridge;

a string extending from the nut to the bridge;

a plurality of frets on the neck; and wherein the neck and the plurality of frets are constructed so that the slope of a line connecting the top of each fret to the top of the next higher fret is such that an angle θ is is defined by a smooth function throughout the plurality of frets, said function being one other than one resulting in a flat planar fretboard, the angle θ being defined as the angle whose vertex is the junction of the string with the top of the fret when the fret is the playing fret, and whose legs are the string and the line from the top of the playing fret to the top of the next higher fret.

67. The instrument of claim 66, wherein the neck and the plurality of frets are constructed so that the slope of the line connecting the top of each fret to the top of the next higher fret is such that the angle θ is substantially constant throughout the plurality of frets.

68. The instrument of claim 66, wherein the neck has a concave longitudinal neck profile.

69. The instrument of claim 66, further comprising:

a second string; and wherein the neck and the plurality of frets are constructed so that the slope of a line connecting the top of each fret to the top of the next higher fret below the second string is such that the angle θ is is defined by a second smooth function throughout the plurality of frets, said second function being different from the first said function.

* * * * *

UNITED STATES PATENT AND TRADEMARK OFFICE

CERTIFICATE OF CORRECTION

PATENT NO : 6,069,306
DATED : May 30, 2000
INVENTOR(S) : Isvan et al.

It is certified that error appears in the above-identified patent and that said Letters Patent are hereby corrected as shown below:

In column 11, line 30 of the specification, insert --value-- after 0.

In column 11, line 67 of the specification, delete "≤" and insert --≥--.

In column 12, line 42 of the specification, please correct "present s" to "presents".

In column 16, page 55, delete "<" and insert --°--.

Signed and Sealed this

Eighth Day of May, 2001

*Attest:*

Nicholas P. Godici

NICHOLAS P. GODICI

*Attesting Officer*

*Acting Director of the United States Patent and Trademark Office*